US006834582B2

(12) United States Patent
Cutcher

(10) Patent No.: US 6,834,582 B2
(45) Date of Patent: Dec. 28, 2004

(54) APPARATUS FOR PRINTING ON A CURVED SUBSTRATE

(75) Inventor: Thomas V. Cutcher, Petersburg, MI (US)

(73) Assignee: Exatec, LLC, Wixom, MI (US)

( * ) Notice: Subject to any disclaimer, the term of this patent is extended or adjusted under 35 U.S.C. 154(b) by 0 days.

(21) Appl. No.: 10/678,777

(22) Filed: Oct. 3, 2003

(65) Prior Publication Data

US 2004/0187713 A1 Sep. 30, 2004

Related U.S. Application Data

(62) Division of application No. 09/886,344, filed on Jun. 21, 2001, now Pat. No. 6,698,345.

(51) Int. Cl.[7] ..... B41F 15/30; B41F 15/46; B41F 15/38

(52) U.S. Cl. ..... 101/123; 101/127.1

(58) Field of Search ..... 101/123, 127.1, 101/127, 129, 35, 41

(56) References Cited

U.S. PATENT DOCUMENTS

| | | | | |
|---|---|---|---|---|
| 2,347,022 A | | 4/1944 | Austin | |
| 2,818,803 A | | 1/1958 | Levorson | |
| 4,184,427 A | | 1/1980 | Bubley | |
| 4,381,706 A | | 5/1983 | Harpold | |
| 5,170,703 A | | 12/1992 | Tu | |
| 5,339,732 A | | 8/1994 | Peterlini | |
| 5,685,221 A | | 11/1997 | Newman | |
| 5,743,182 A | | 4/1998 | Kobayashi | |
| 5,806,425 A | | 9/1998 | Newman | |
| 6,041,702 A | | 3/2000 | Ichikawa | |
| 6,138,560 A | | 10/2000 | Chen | |
| 2002/0195007 A1 | * | 12/2002 | Sano et al. | 101/123 |

FOREIGN PATENT DOCUMENTS

| | | | | |
|---|---|---|---|---|
| DE | 2001186616 | | 2/2001 | |
| FR | 2515113 | | 4/1983 | |
| JP | 60131246 A | * | 7/1985 | B41F/15/34 |
| JP | 01232192 | | 9/1989 | |
| JP | 06053737 A | * | 2/1994 | H01Q/15/16 |
| JP | 11289148 A | * | 10/1999 | H05K/3/00 |
| JP | 2000318120 | | 11/2000 | |
| SU | 1773733 | | 11/1992 | |

* cited by examiner

*Primary Examiner*—Daniel J. Colilla
(74) *Attorney, Agent, or Firm*—Brinks Hofer Gilson & Lione

(57) ABSTRACT

An apparatus for, and a method of, printing a precise pattern on the inside radius of a curved substrate by the pivotal movement of a pendulum moving across the surface of a screen capable of receiving and transferring an ink, is disclosed.

67 Claims, 23 Drawing Sheets

(SIDE VIEW)

APPARATUS FOR PRINTING ON A CURVED SUBSTRATE

RELATED APPLICATION

This application is a divisional application of application Ser. No. 09/886,344 filed Jun. 21, 2001, now U.S. Pat. No. 6,698,345 which is incorporated by reference in its entirety.

BACKGROUND OF THE INVENTION

1. Field of the Invention

The present invention relates to an apparatus for, and a method of, printing a pattern on the inside radius of a curved substrate. More particularly, the present invention relates to an apparatus for, and a method of, printing a precise pattern on the inside radius of a curved substrate by the pivotal movement of a pendulum across the surface of a screen which is capable of receiving and transferring a printing ink to a surface of the curved substrate.

2. Discussion of the Related Art

Various methods of printing patterns on flat substrates have long been known. Methods of printing patterns on the outside radius of a curved surface are also known. It has been difficult, however, to find a reliable means to print complex, precise patterns on the inside surface, or inside radius, of a curved substrate. Such printing means would be particularly applicable to curved substrates, such as plastics or glass, which could be used as automotive glazings.

Examples of conventional printing apparati and methods of printing are disclosed in, for example:

U.S. Pat. No. 6,041,702 teaches a screen printing apparatus for screen printing on curved objects with relatively large radii of curvature, but does not teach a method or apparatus to print on the inside curve of such an object.

U.S. Pat. No. 5,743,182 teaches a stencil printing method and apparatus for printing directly on a curved surface, but again, teaches only printing on the outside surface of an object, and a moving diaphragm, rather than a pendulum, effects the printing of a pattern on the substrate.

U.S. Pat. No. 5,339,732 teaches a machine for printing on the outside of containers through use of a squeegee device, however, it does not teach printing on the inside radius of a curved surface, nor does it teach a pendulum printing apparatus.

U.S. Pat. No. 5,170,703 teaches a machine for printing a curved surface, but does not teach printing on the inside radius of a curved surface, use of a non-stationary squeegee or use of a printing screen conformable to the substrate on which the pattern is to be printed.

U.S. Pat. No. 4,381,706 teaches a screen for printing on curved surfaces comprising a flexible frame which allows certain segments of the frame to flex into a shape complementary with the shape of the article to be printed. The patent does not teach, however, a pendulum-mounted squeegee for printing, nor does it teach printing on the inside radius of a curved surface.

International Application Publication No. WO00/78520, filed Jun. 22, 2000, teaches a process for manufacturing molded plastic curved automotive window panels in which a blackout and decorative border is printed on the perimeter of the panel with ink. To print on the curved surface of the window panel a squeegee wiper is mounted on a pendulum arm to provide a constant angle position as the screen is wiped by a swinging movement of the pendulum. A hinged frame allows it to roughly assume the same of the panel curvature.

Accordingly, it would be advantageous to have a method of printing on the inside surface of a curved substrate, and to provide a relatively simple apparatus capable of doing so. It would be particularly advantageous to have such an apparatus and method of printing which is adaptable to high-volume manufacturing of, for example, curved, plastic, or glass automotive glazings.

SUMMARY OF THE INVENTION

The present invention addresses the problem of printing a variety of precise patterns on a substrate material having a curved shape. This capability is particularly useful where first printing such a pattern and then attempting to bend the flat substrate material could cause deformation or marring of the printed pattern. The present invention is useful where the substrate is a plastic material, and is particularly useful where the substrate is an injection molded cylindrical polycarbonate material, such as can be used for an automotive glazing for windows.

More specifically, the apparatus and method of the present invention may be employed to print a pattern on the inside radius of a curved substrate where the radius of curvature is approximately 20–80 inches, measured from the pivotal mounting point of the pendulum, which is a component of the present invention, to the uppermost surface of the substrate on which a pattern is to be printed.

Another component of the apparatus of the present invention is the screen and the screen mounting frame which, prior to deflection, are in a generally flat, horizontal position above the curved substrate. The substrate is supported by a support member, itself having a curved surface, which, in general, conforms to the shape of the curved substrate. While in the flat, horizontal position, a flood bar is actuated, and moves across the screen, ensuring that the desired portion of the screen is uniformly covered with ink. Various printing inks suitable for different applications may be used in conjunction with the present invention.

The screen and screen mounting frame move, typically, in a downward direction, so that the screen substantially conforms with the shape of the curved substrate which has been placed beneath the screen. Once properly conformed to the shape of the curved substrate, a means for spreading printing ink across the now-curved screen moves across the screen. The means attached to a pendulum capable of pivotal movement is actuated and moves arcuately across the screen, with sufficient pressure being applied to the spreading means to transfer the ink through the mesh of the screen onto the inside radius of the curved substrate. Preferably, the spreading means is a squeegee, the material for the spreading edge of such squeegee being any suitable material such as a polyurethane material which is well-known in the art for squeegee construction.

The length of the pendulum arm may be fixed or preferably the length of the pendulum arm may be adjustable so that it is capable of printing on curved substrates having radii of curvature between 20 and 80 inches, although, preferably between 38 and 60 inches.

Similarly, a number of different support members having differing shapes and curvatures may be utilized to accommodate substrates having different curvatures. This may be acceptable if only a small number of different curvatures is desired. If, however, a significant number of parts having different curvatures is envisioned, or rapid changeover from one curvature to another is anticipated, a single support member having substantial capability to adjust its shape might be desirable. Accordingly, both fixed and adjustable support members are disclosed herein.

BRIEF DESCRIPTION OF THE DRAWINGS

The above, as well as other advantages of the present invention, will become readily apparent to those skilled in the art from the following detailed description when considered in the light of the accompanying drawings in which.

DETAILED DESCRIPTION OF THE PREFERRED EMBODIMENTS

Figure 1:
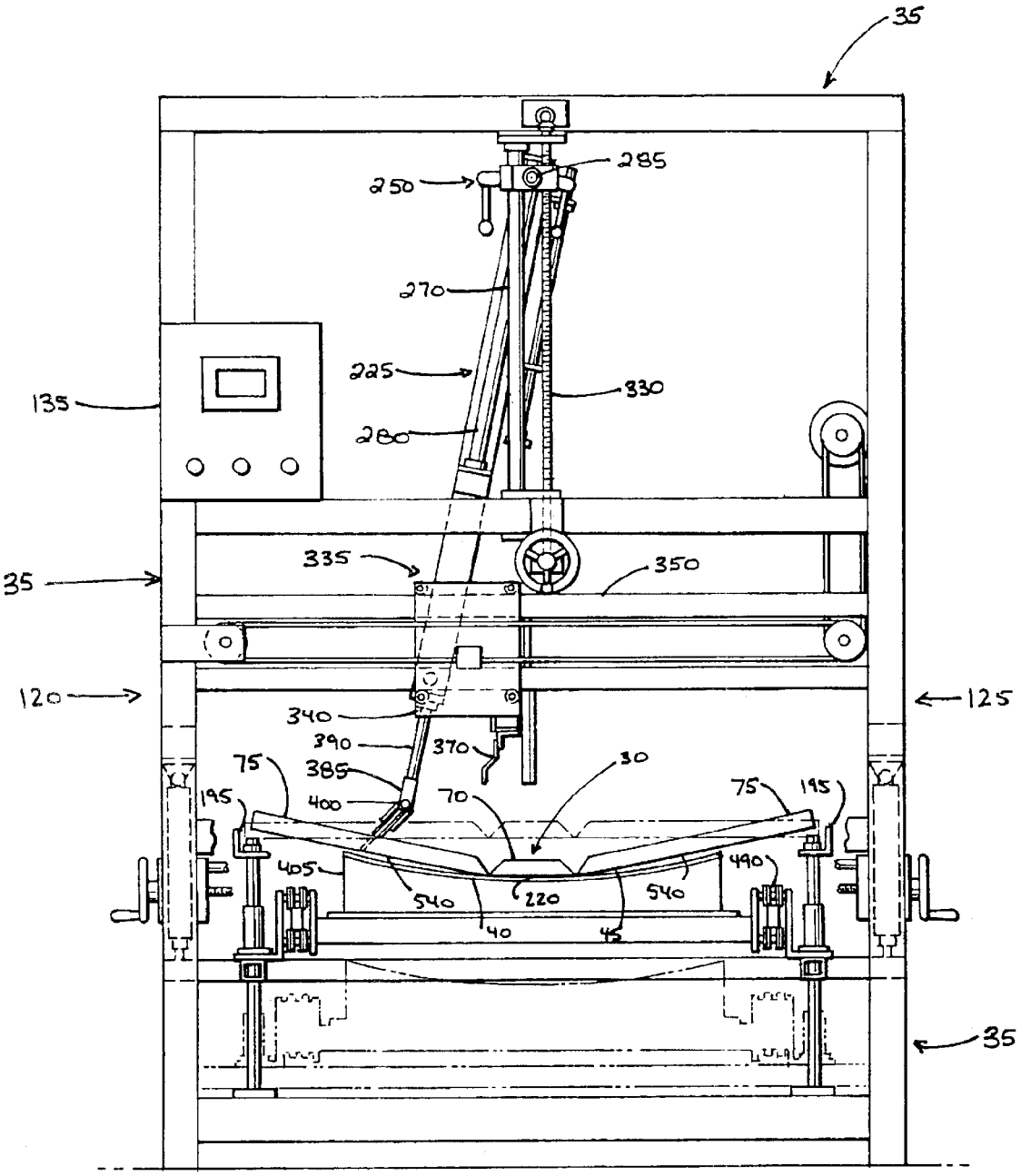
FIG. 1 is a perspective view of a construction embodying the present invention.
Figure 2:
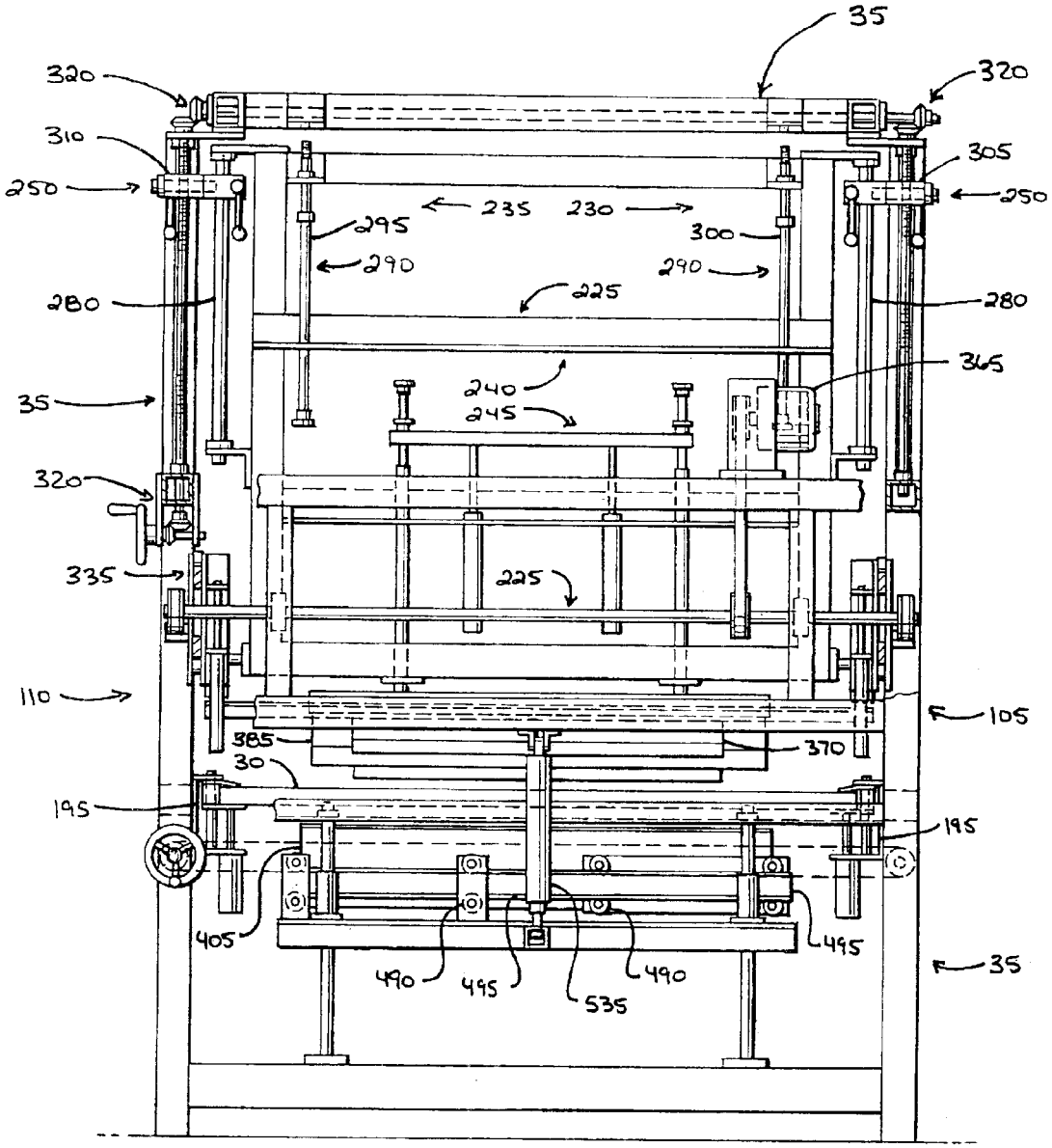
FIG. 2 is another perspective view of a construction embodying the present invention.

Referring now to FIGS. 1 and 2, a screen mounting frame 30 is depicted within a support structure denoted generally by the numeral 35. Preferably, the screen mounting frame 3Q is conformable to a curved substrate 40 having an inside radius 45 on which printing is to be effected. In a preferred embodiment, the curved substrate 40 has an inside radius 45 of approximately 20 to 80 inches. In a more preferred embodiment, the curved substrate 401 has an inside radius 45 of approximately 38 to 60 inches. The substrate 40 is preferably constructed of a polycarbonate material. The substrate material is not limited only to polycarbonate material but also includes materials commonly classified as plastics, glass or any other material.

Figure 3:
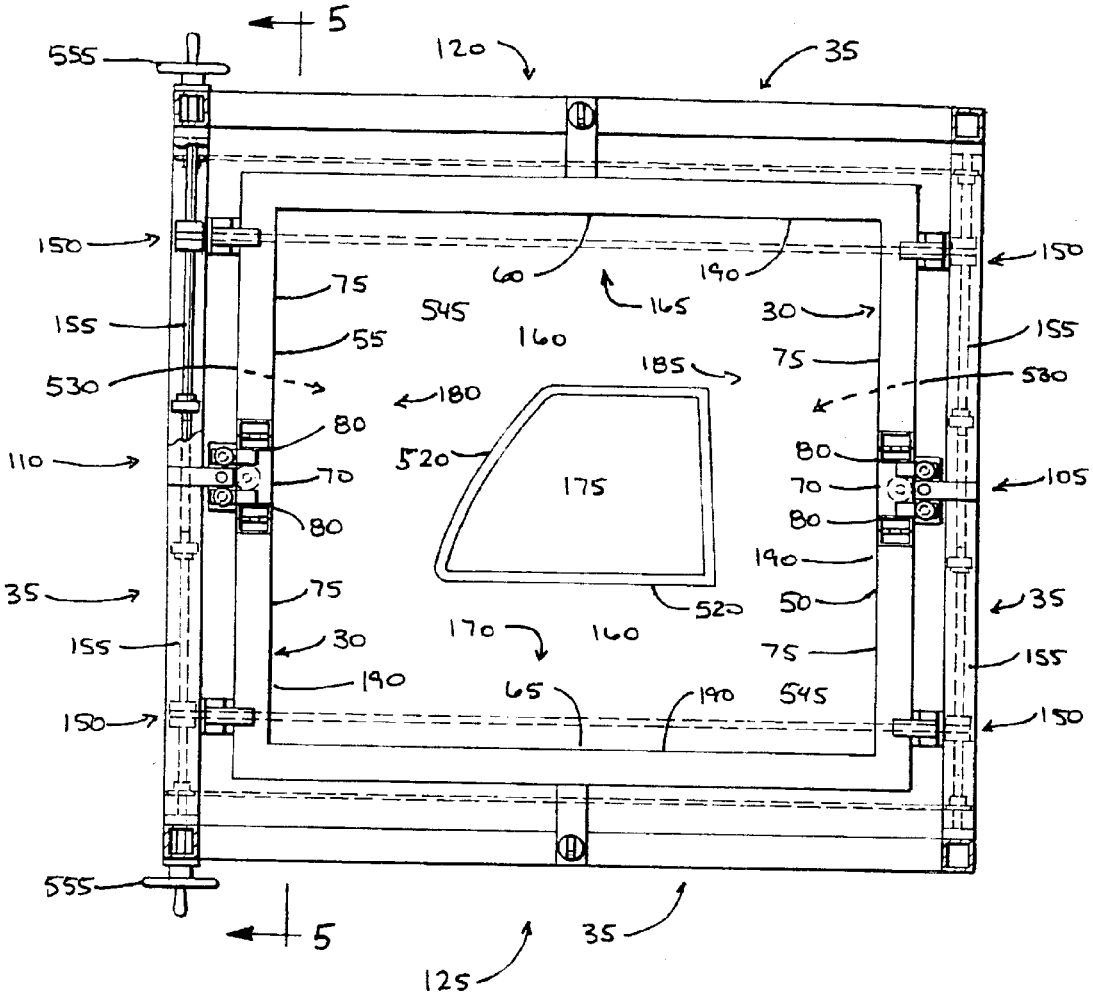
FIG. 3 is a top view of a screen, a screen mounting frame and a support member embodying the construction of the present invention.
Figure 5:
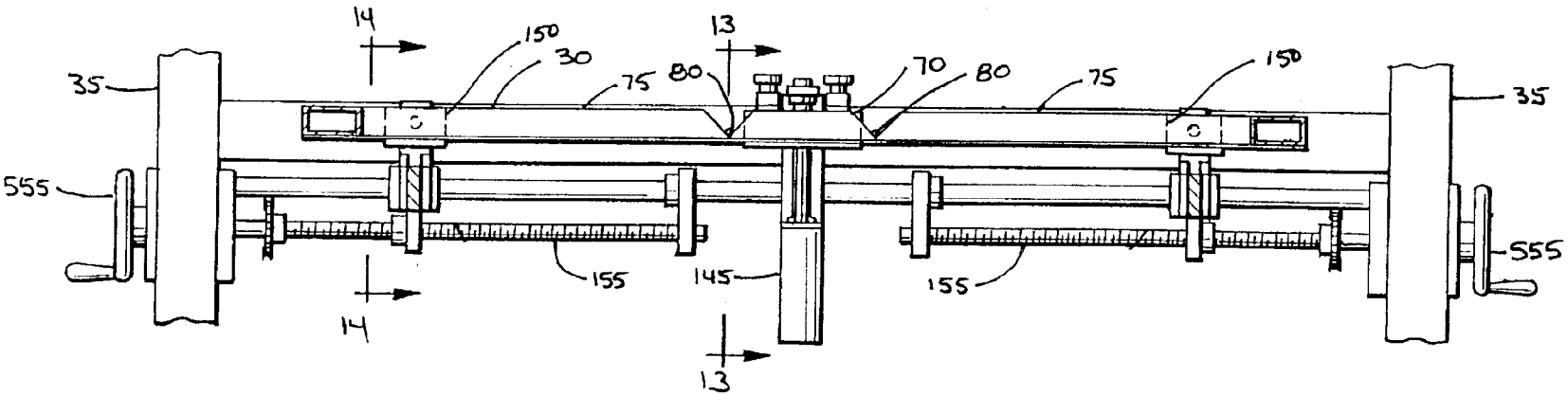
FIG. 5 is a sectional view, taken in the direction of the arrows, along section line 5—5 of FIG. 3.
Figure 6:
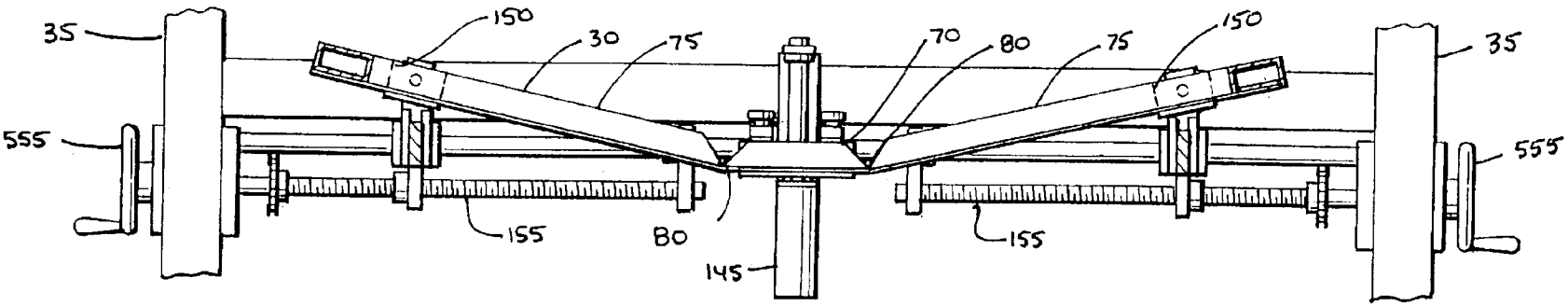
FIG. 6 is a side view of the construction shown in FIG. 3.
Figure 7:
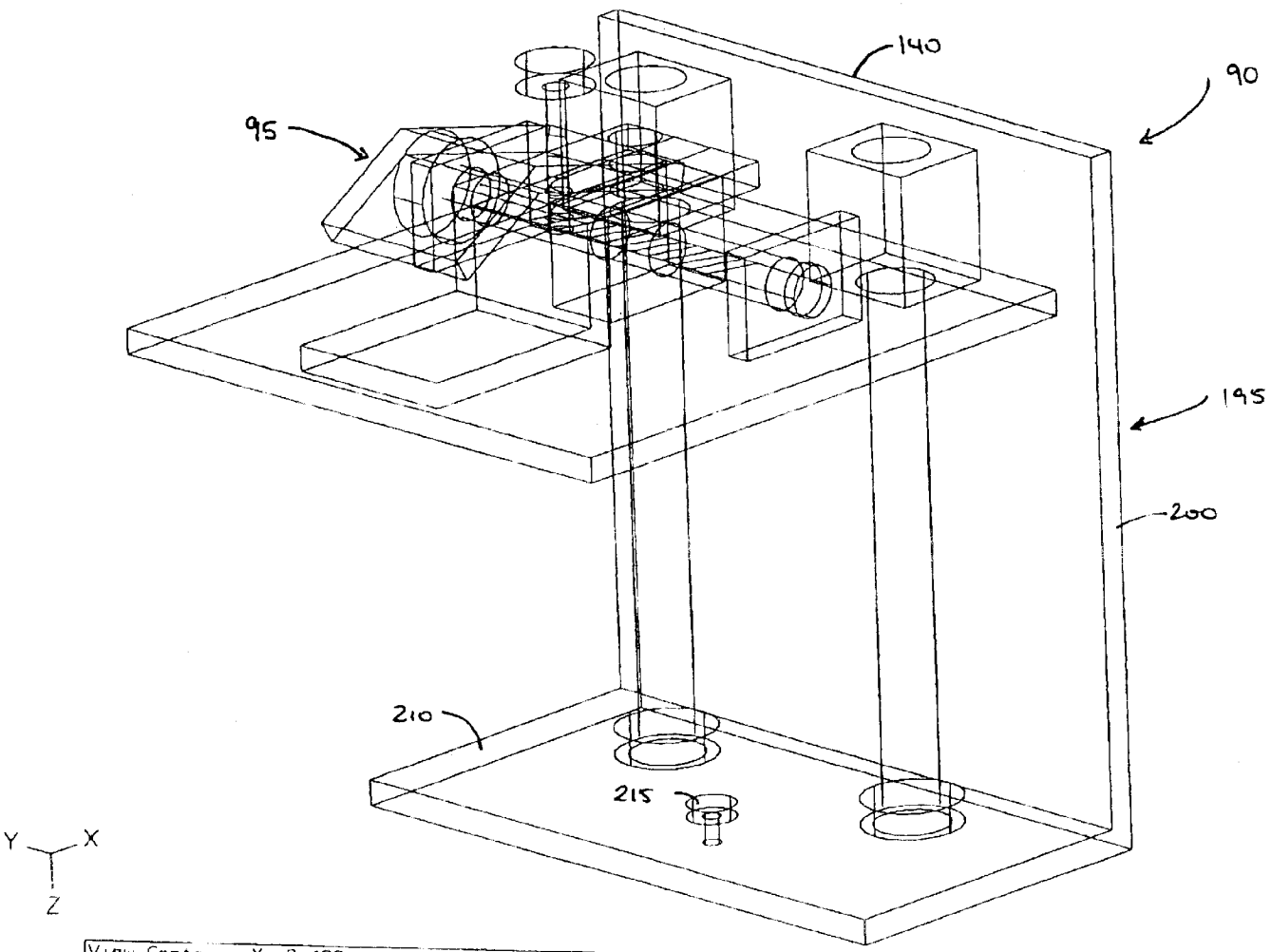
FIG. 7 is an isometric view of a screen mounting frame locator.
Figure 8:
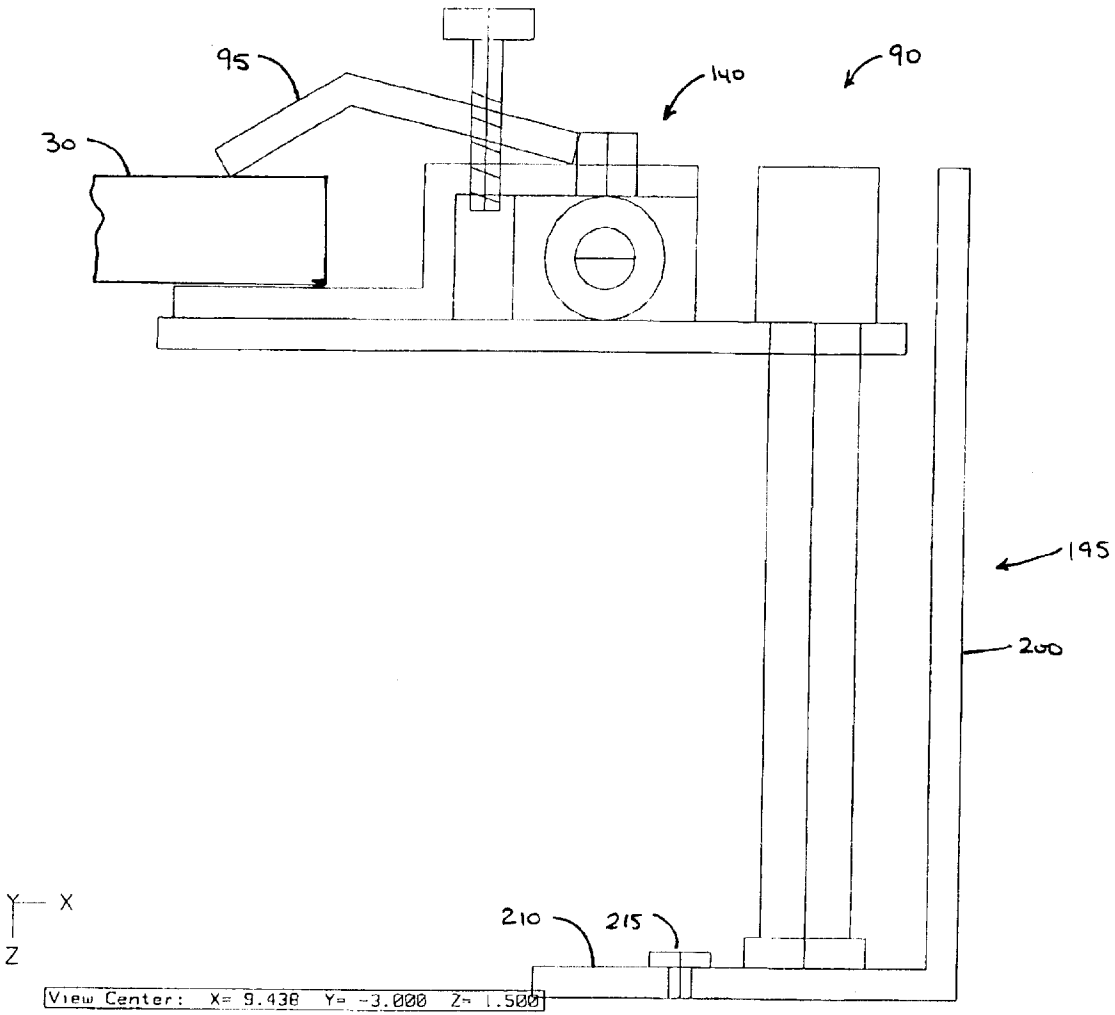
FIG. 8 is a side view of a screen mounting frame locator.
Figure 9:
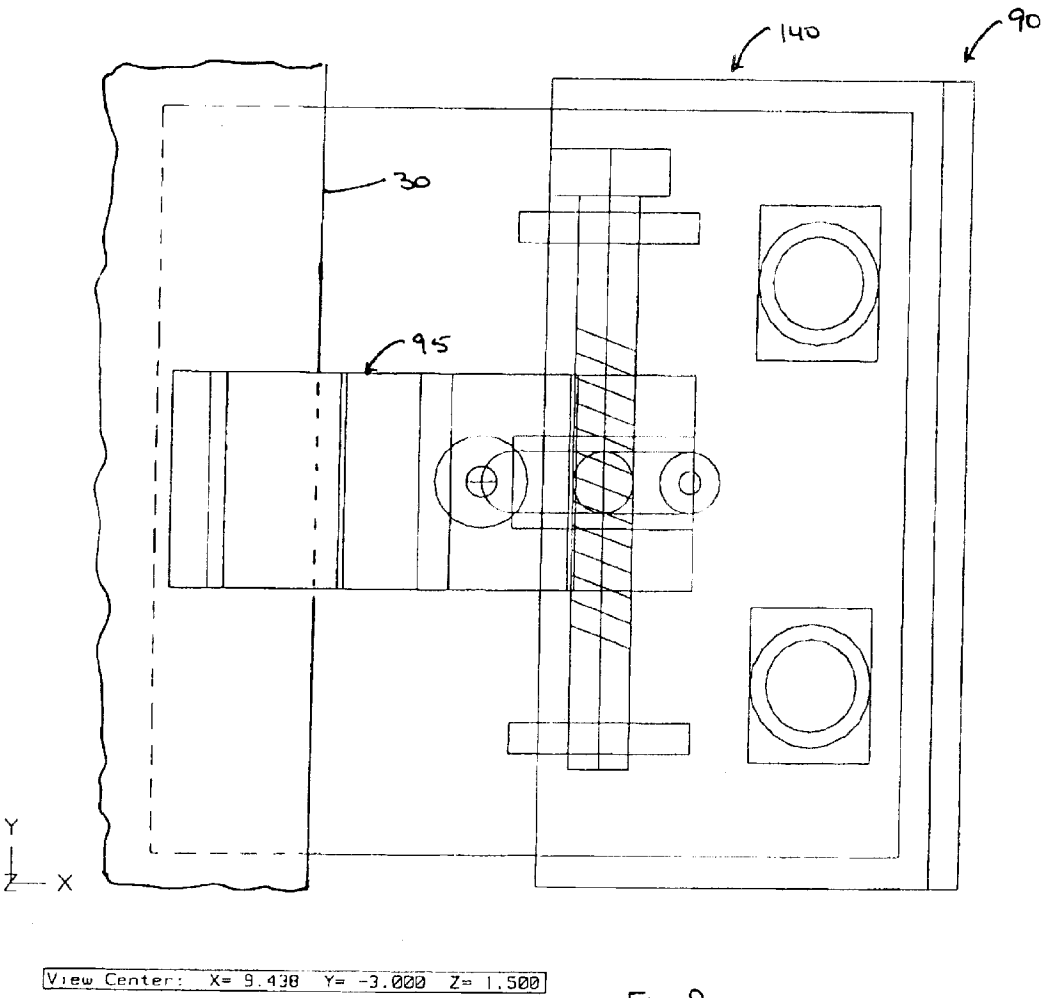
FIG. 9 is a top view of a screen mounting frame locator.
Figure 10:
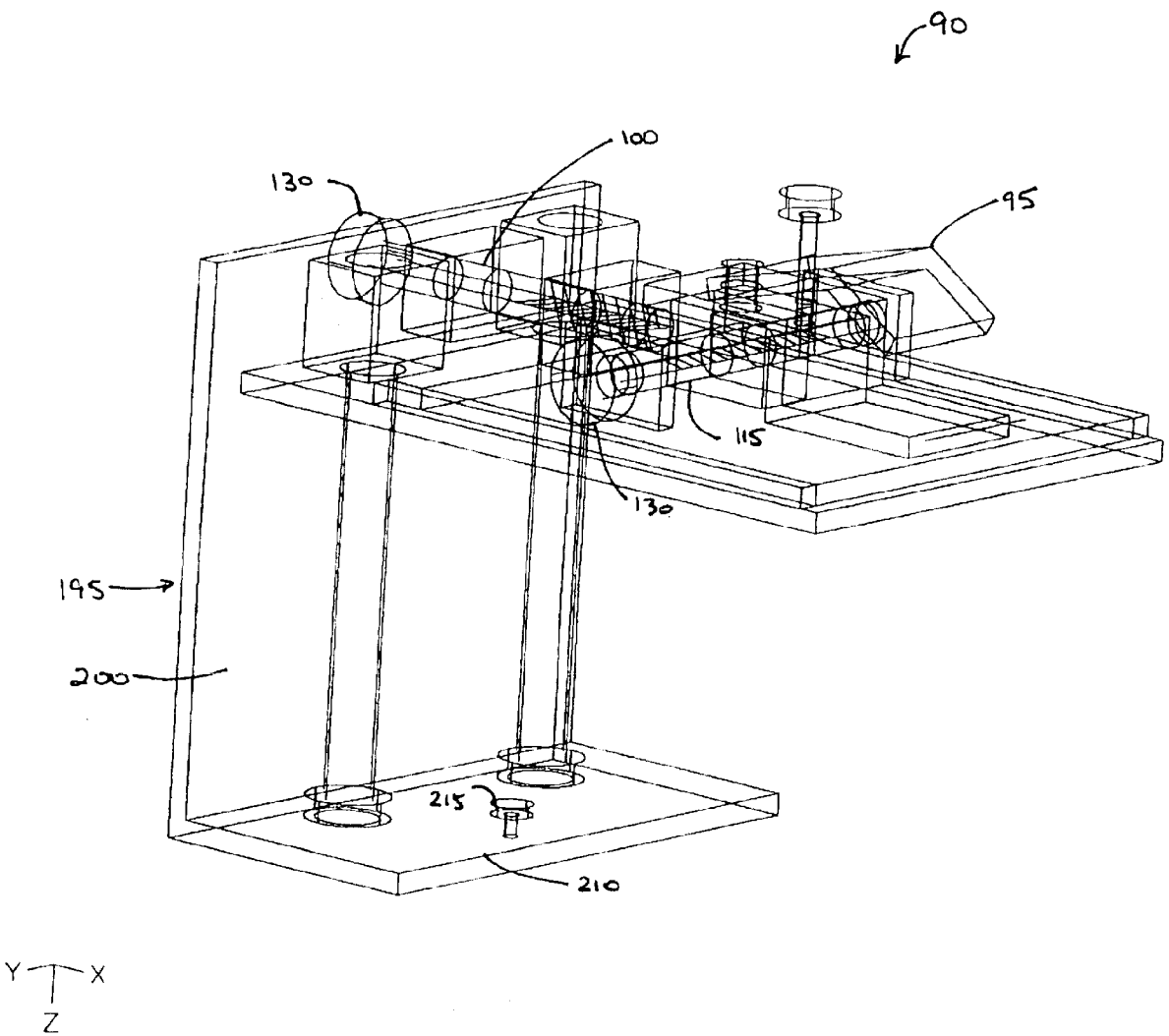
FIG. 10 is an isometric view of another embodiment of the screen mounting frame locator.
Figure 11:
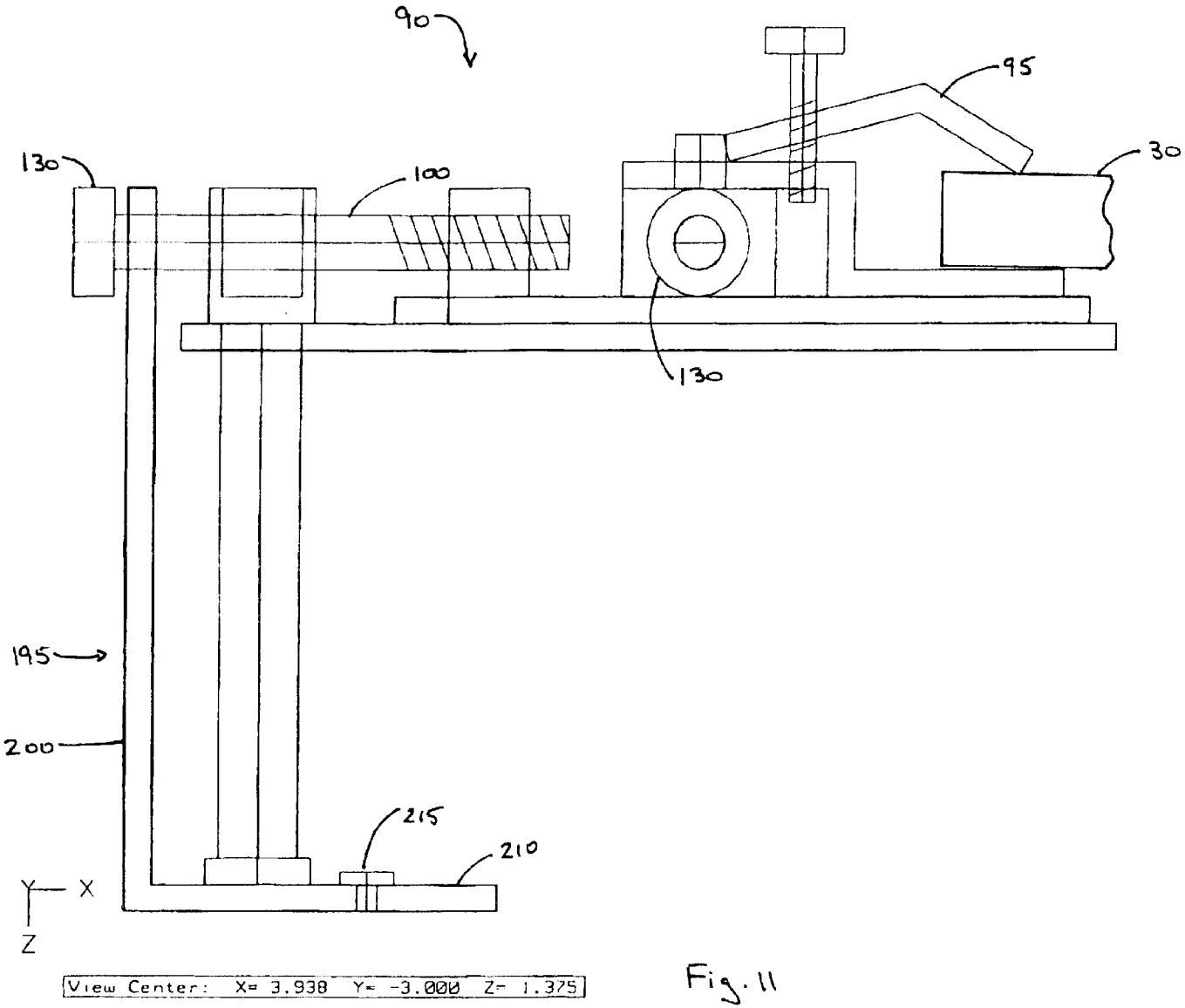
FIG. 11 is a side view of the screen mounting frame locator of FIG. 10.
Figure 12:
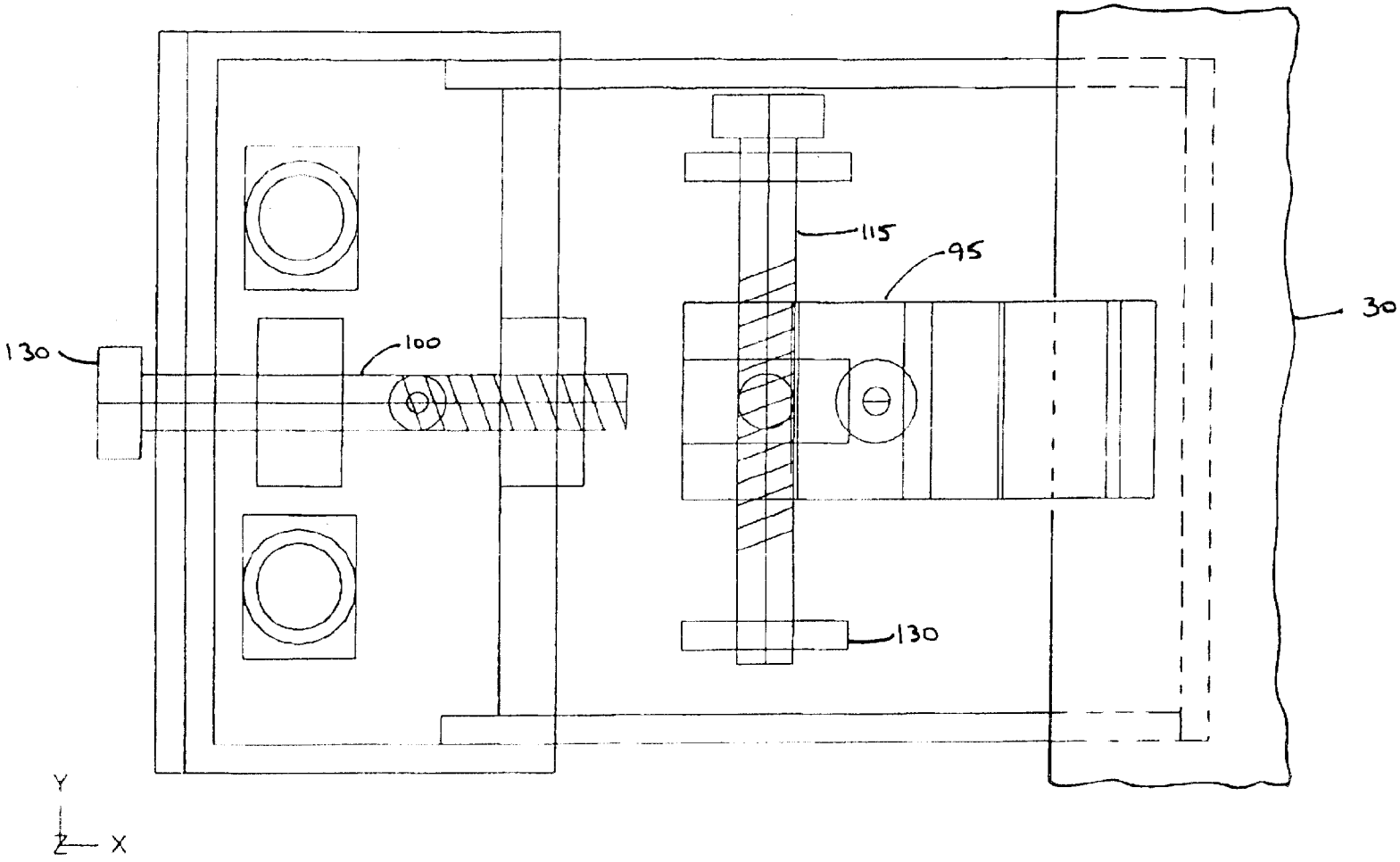
FIG. 12 is a top view of the screen mounting frame locator of FIG. 10.

As seen in FIG. 3, the screen mounting frame 30 has a right side 50, a left side 55, a front portion 60 and a rear portion 65. Preferably, the right 50 and left 55 sides each have a vertically moveable center portion 70 and at least two vertically moveable end portions 75. The center portion 70 is bounded by at least two hinges 80 as illustrated in FIGS. 3 and 5–6.

Figure 13:
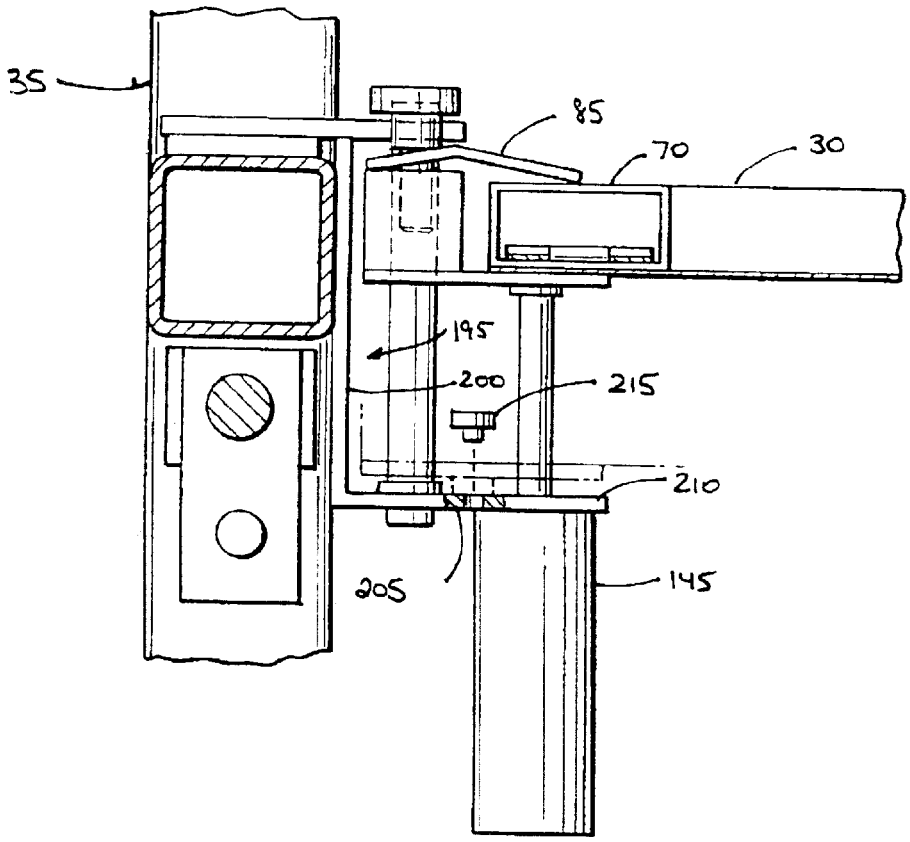
FIG. 13 is a sectional view, taken in the direction of the arrows, along section line 13—13 of FIG. 5.
Figure 14:
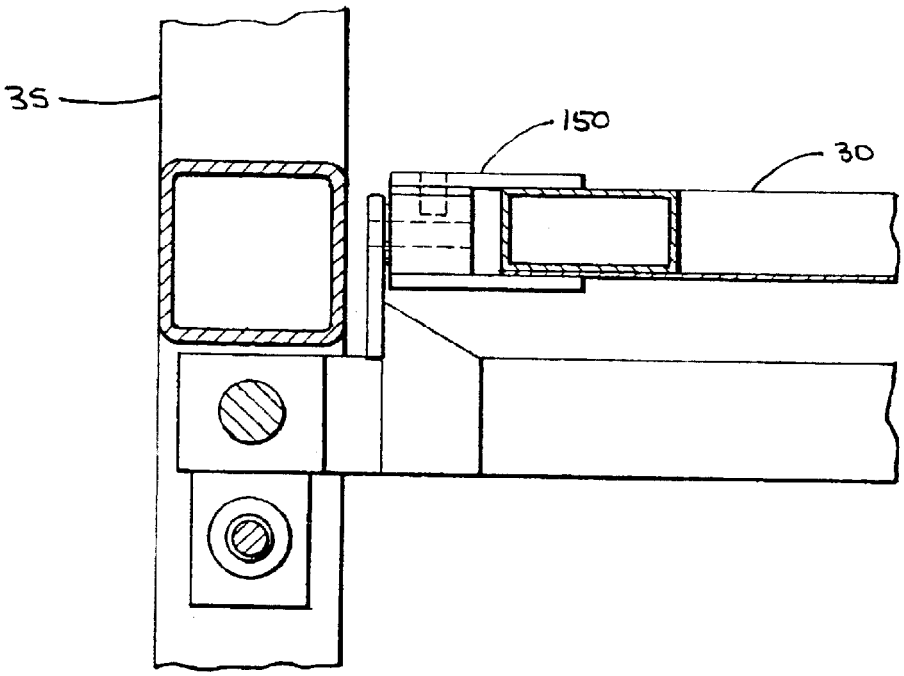
FIG. 14 is a sectional view, taken along the direction of the arrows, along section line 14—14 of FIG. 5.

In one embodiment depicted in FIG. 13, the center portion 70 is removably attached to a means for vertical movement by a clamp 85. In an alternative embodiment depicted in FIGS. 7 through 12, a screen mounting frame locator 90 is used in place of the clamp 85. The screen mounting frame locator 90 has a clamping portion 95 for placing the screen mounting frame 30 therein. The position of the screen mounting frame 30 is adjustable within the clamping portion 95 thereby allowing the screen mounting frame 30 to be adjusted with respect to the substrate 40. A first driving rod 100 is connected to the clamping portion 95. The first driving rod 100 urges the clamping portion 95 to a right 105 or a left 110 side of the support structure 35 as depicted in FIG. 3. A second driving rod 115 urges the clamping portion 95 to a front 120 or a rear 115 portion (see e.g. FIG. 1 or 2) of the support structure 35. The first 100 and second 115 driving rods are manually adjustable by rotating knobs 130 located on the end of each rod 100, 115. Alternatively, the rods 100, 115 are adjustable by computer activated means 135.

A screen mounting frame locator without driving rods 140 is located substantially opposite on the screen mounting frame 30 of the screen mounting frame locator 90 with driving rods 100, 115. The screen mounting frame 30 is slidably located within this locator 140 to allow the screen mounting frame 30 to be adjusted over the substrate 40.

In a preferred embodiment, the means for vertical motion is a motor (not shown) connected to the center portion. In a more preferred embodiment depicted in FIGS. 5 and 6, the means for vertical motion is at least one fluid driven cylinder 145 connected to the center portion 70. The cylinder 145 is preferably pneumatically or hydraulically driven.

As depicted in FIGS. 5 and 6, the vertically moveable end portions 75 are removably attached to the support structure 35 with pivotal clamps 150. Preferably, the pivotal clamps 150 are slidably located along the end portions 75 of the screen mounting frame 30. A threaded, substantially horizontal rod 155 threadably engages each pivotal clamp 150. Rotating the rod 155 one direction causes the pivotal clamps 150 to diverge while rotating the rod 155 in the opposite direction causes the clamps 150 to converge.

Both the center portion 70 and the vertically moveable end portions 75 are removably attached to the support structure 35 to allow for the screen mounting frame 30 to be removed for repair or replacement.

As shown in FIG. 3, a screen 160, having a leading portion 165, a trailing portion 170, a center portion 175, a left portion 180, a right portion 185 and a perimeter 190 is located within the screen mounting frame 30 preferably with an adhesive (not shown). The adhesive may be such as those commonly known by those skilled in the art for securing screens 160 to screen mounting frames 30. Preferably, the screen perimeter 190 is secured to the screen mounting frame 30 with the adhesive.

In a preferred embodiment, the screen 160 is a high tension, low elongation material capable of receiving and transferring a pigment containing material, such as printing ink. In a more preferred embodiment, the screen 160 is a monofilament polyester material. The screen 160 may be such as that available from Dynamesh of West Chicago, Ill.

Figure 4:
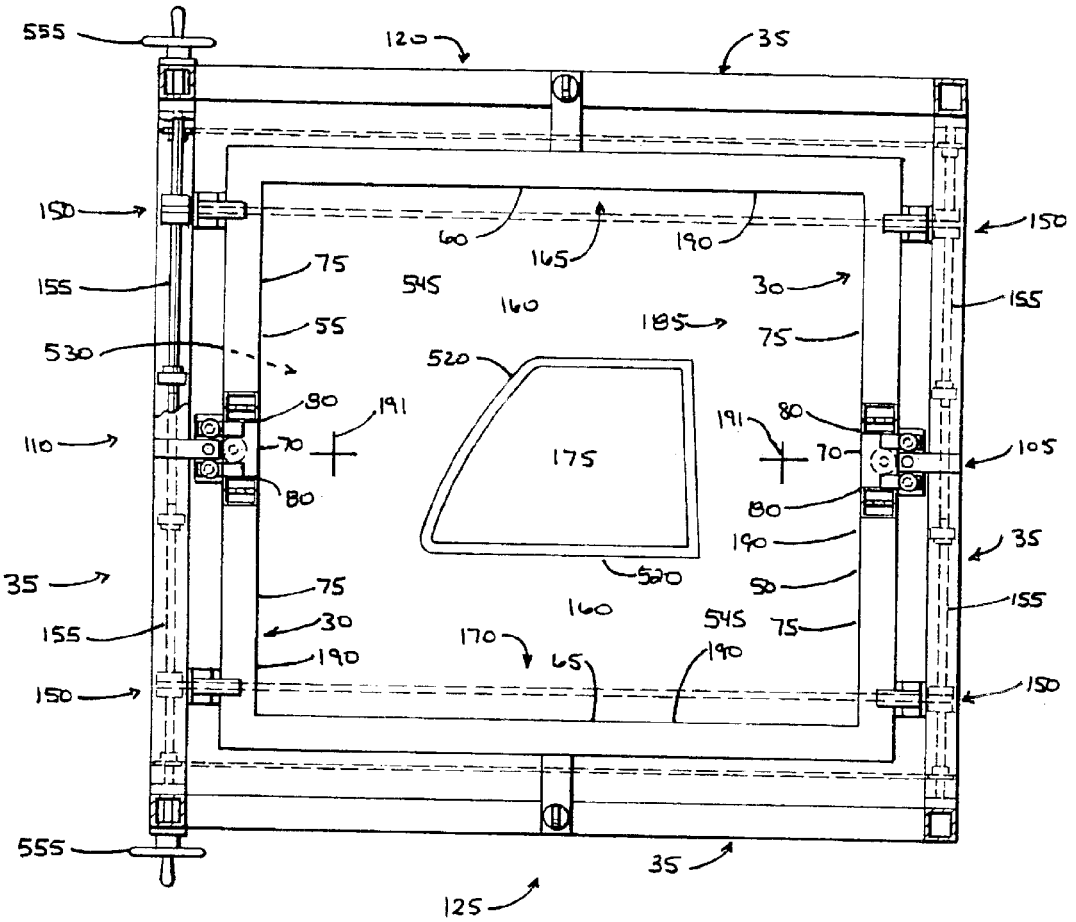
FIG. 4 is a top view of a screen with crosshairs located thereon embodying the construction of the present invention.

In an alternative embodiment depicted in FIG. 4, the screen 160 has located thereon at least two crosshairs 191. The crosshairs 191 are used to align the screen 160 with the substrate 40 as will be described in more detail below.

As depicted in FIG. 13, the support structure 30 has at least two flanges 195 for locating thereon the right 50 and left 55 (see e.g., FIG. 3) sides of the screen mounting frame 30. Preferably, the flanges 195 are an "L" shaped structure with a vertical portion 200 of the "L" positioned to resist, or prevent, motion imparted to the screen 160 from the printing process.

Each flange 195 has a plurality of apertures 205 located in a horizontal portion 21:0 of the "L". One or more spacers 215 may be located in the apertures 205 to elevate the screen mounting frame 30 off the horizontal portion. The spacers 215 increase the distance 220 (see e.g., FIG. 1) between the center portion 175 of the screen 160 and the substrate 40.

A pendulum 225 is connected to the support structure 35 for pivotal movement above the screen 160. The pendulum 225 has a right side 230, a left side 235, an upper portion 2401 and a lower portion 245, as illustrated in FIG. 2. In a preferred embodiment, the pendulum 225 has at least one pivotal mounting 250 connected to the support structure 35. In a most preferred embodiment, the pendulum 225 has a pivotal mounting 250 on the right side 230 and the left side 235.

In one embodiment, the radius of the pendulum 225 is fixed (not shown). The fixed radius allows printing on substrates 40 having a curvature which substantially conforms to the radius of the pendulum 225. The pendulum 225 must be replaced with a new pendulum 225 having a different radius if the curvature of the substrate 40 does not conform to the radius of the pendulum 225.

Figure 15:
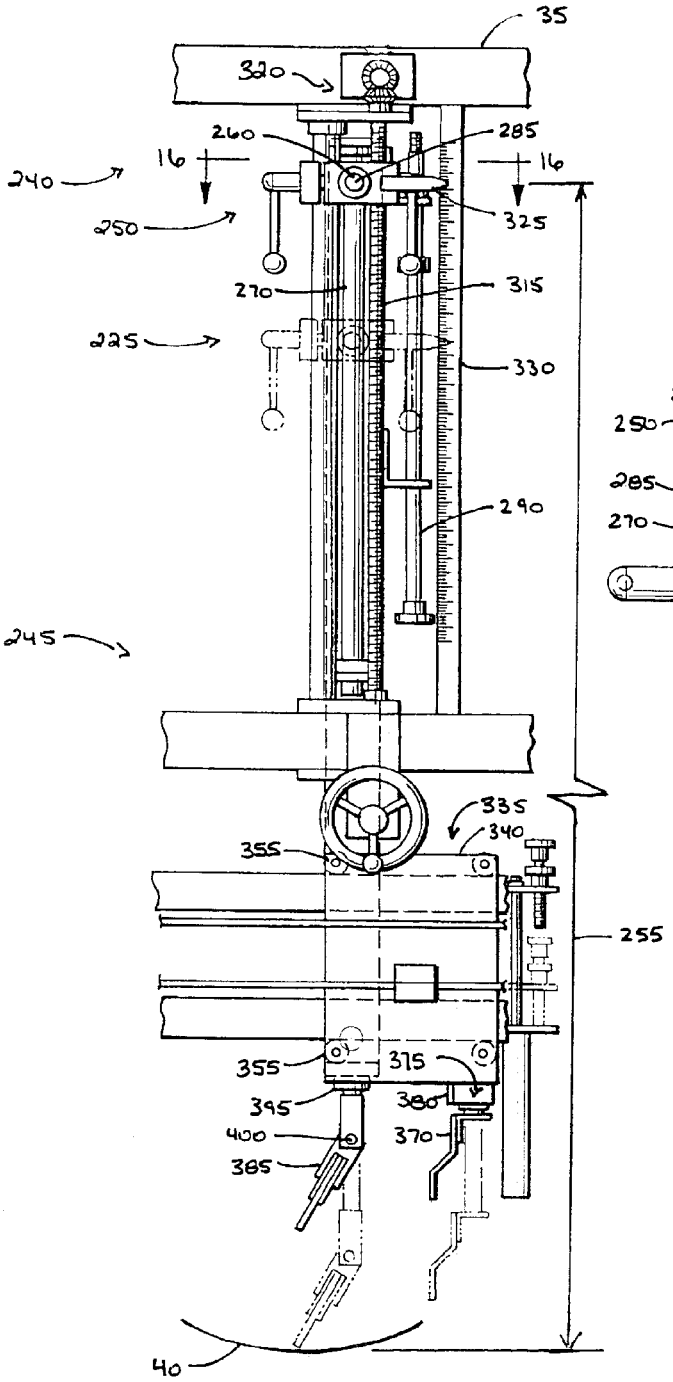
FIG. 15 is a fragmentary sectional view showing a portion of the construction shown in FIG. 1.

In a preferred embodiment depicted in FIG. 15, the pivotal mountings 250 are adjustable to allow the pendulum 225 to travel through a plurality of radii for printing on substrates 40 with different curvatures. In this embodiment, the radius 255 of the pendulum 225 is adjustable from approximately 20 to 80 inches, with the radius 255 of the pendulum 225 being preferably adjustable from approximately 38 to 60 inches. The radius 255 of the pendulum 225 is measured from the center 260 of the pivotal mounting 250 to the curved substrate 40.

Figure 16:
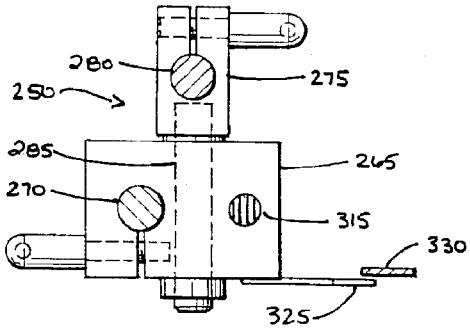
FIG. 16 is a sectional view, taken in the direction of the arrows, along section line 16—16 of FIG. 15.

The pivotal mounting 250 has a first side 265 releasably attached to a support structure pivotal mounting bar 270 and a second side 275 releasably attached to a pendulum pivotal mounting bar 280 as illustrated in FIG. 15. The support structure pivotal mounting bar 270 is connected to the support structure 30 and the pendulum pivotal mounting bar 280 is connected to the pendulum 225. As depicted in FIG. 16, the two sides 265, 275 are connected by an axle 285 which allows the sides 265, 275 to turn with respect to one another when the pendulum 225 is in motion. When the first side 265 of the pivotal mounting 250 is attached to the support structure pivotal mounting bar 270 and the second side 275 is attached to the pendulum pivotal mounting bar 280, the entire weight of the pendulum 225 is supported by the pivotal mounting 250.

When the radius 255 of the pendulum 225 must be adjusted, the weight of the pendulum 225 must be removed from the pivotal mounting 250. The pendulum 225 has at least one locking rod 290 for locking the pendulum 225 to the support structure 35. Preferably, a left 295 and a right 300 locking rod are connected to the pendulum 225 and are releasably connected to the support structure 35. When engaged with the support structure 35, the locking rods 295, 300 support the weight of the pendulum 225, thereby removing the weight from the pivotal mountings 250.

Figure 17:
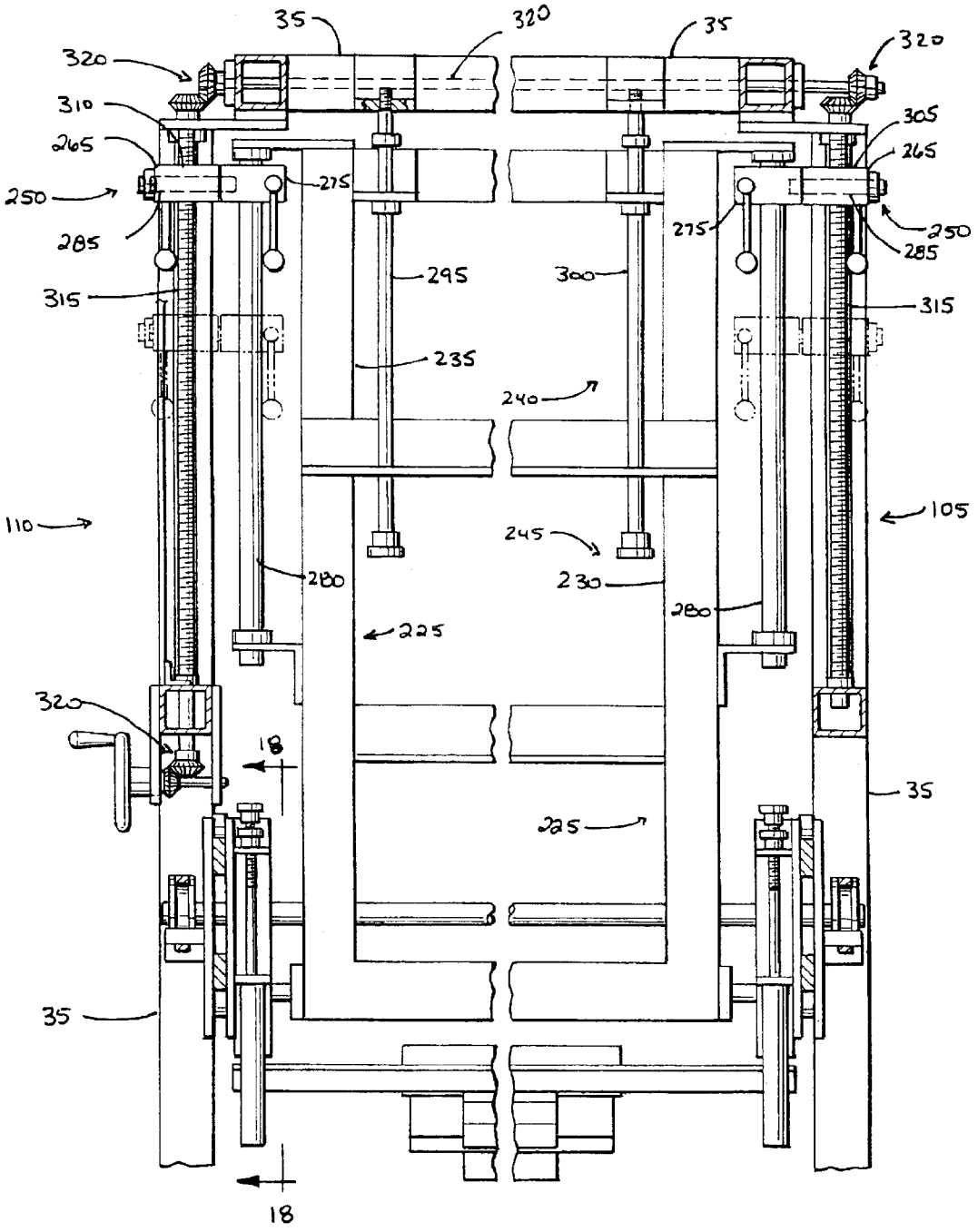
FIG. 17 is a fragmentary sectional view showing a portion of the construction shown in FIG. 2.

As depicted in FIG. 15, a right 305 and a left 310 pivotal mounting-are each preferably engaged with a threaded, substantially vertical rod 315. The rod 315 moves the pivotal mountings 305, 310 up or down when not attached to the support structure pivotal mounting bar 270 and the pendulum pivotal mounting bar 280. In a most preferred embodiment, the threaded vertical rods 315 of the right 305 and left 310 pivotal mountings are mechanically connected by gearing 320 so that the movement and positioning of one creates substantially identical movement and positioning in the other as illustrated in FIG. 17.

An indicator 325 for indicating the radius 255 set for the pendulum 225 is preferably connected to the pivotal mounting 250. The indicator 325 points to a graduated index 330 connected to the support structure 35.

Figure 18:
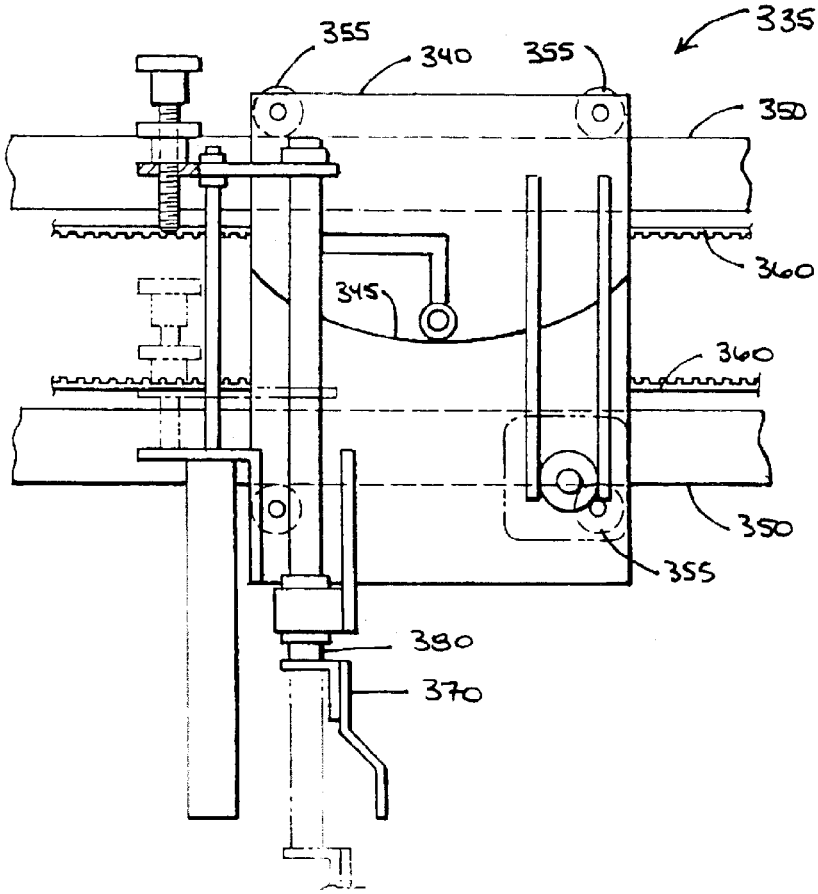
FIG. 18 is a sectional view, taken in the direction of the arrows, along section line 18—18 of FIG. 17.

As shown in FIG. 18, the pendulum 225 is connected to translation means 335 for translating the pendulum 225 across the screen 160. In a preferred embodiment, the translation means 335 is a carriage 340 connected to the right 230 and left 235 (see e.g., FIG. 2) sides of the pendulum 225 and moveably connected to the support structure 35. In a more preferred embodiment, the pendulum 225 is connected to a cam 345 located within the carriage 340. The shape of the cam 345 compensates for the pendular motion of the pendulum 225 as the carriage 340 travels along at least one substantially horizontal track 350 during the printing process. A plurality of wheels 355 connected to each carriage 340 rides on at least one track 350 connected to the support structure 35.

Preferably, the carriages 340 are driven by at least one belt 360 connected to at least one electrically powered motor 365, however, other driving means such as hydraulic or pneumatic cylinders are within the scope of this invention. A computer 135 is in communication with the motor 365 to control the motor 365 according to the printing process.

Figure 31:
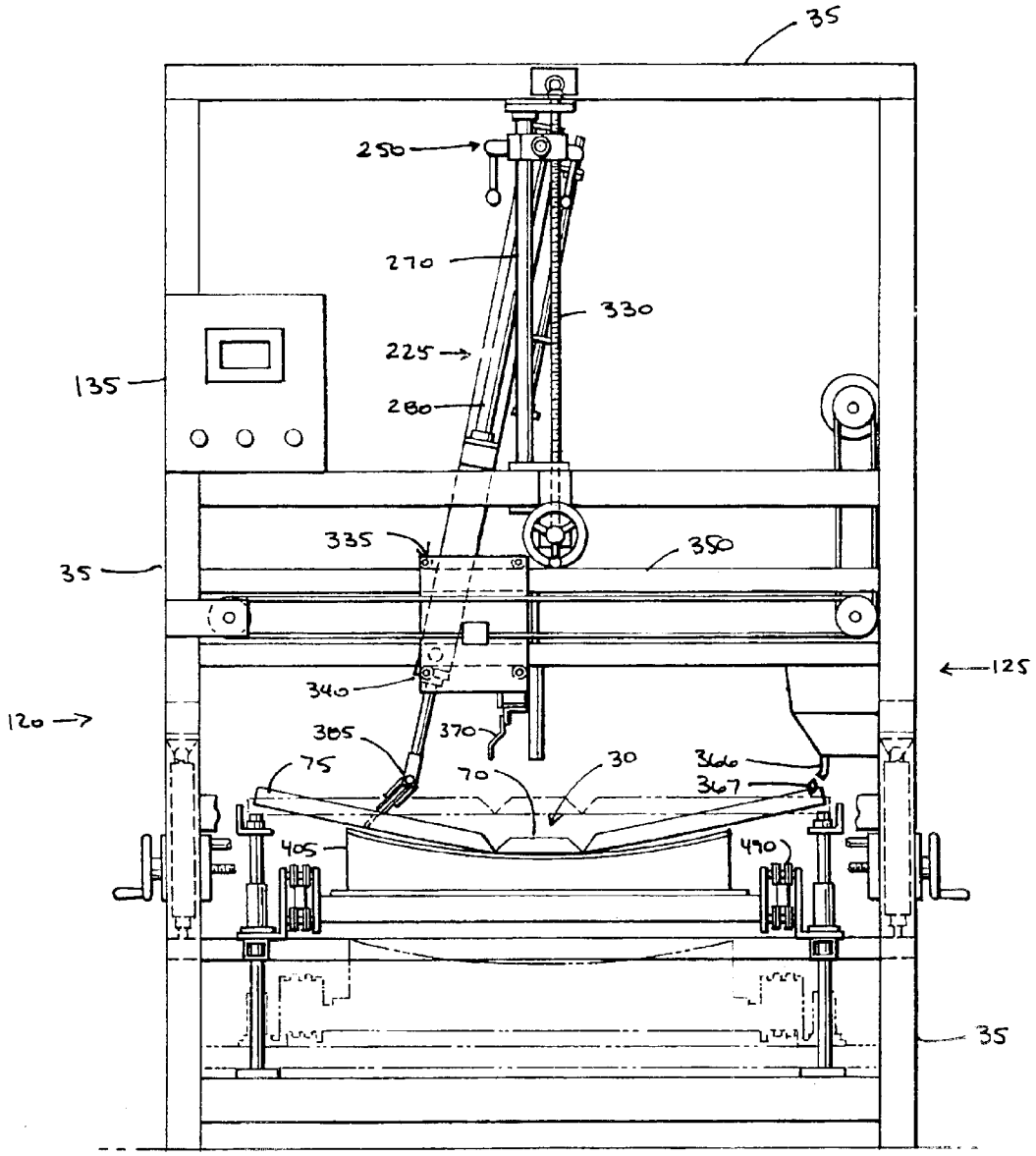
FIG. 31 is a perspective view of a construction embodying the present invention.
Figure 32:
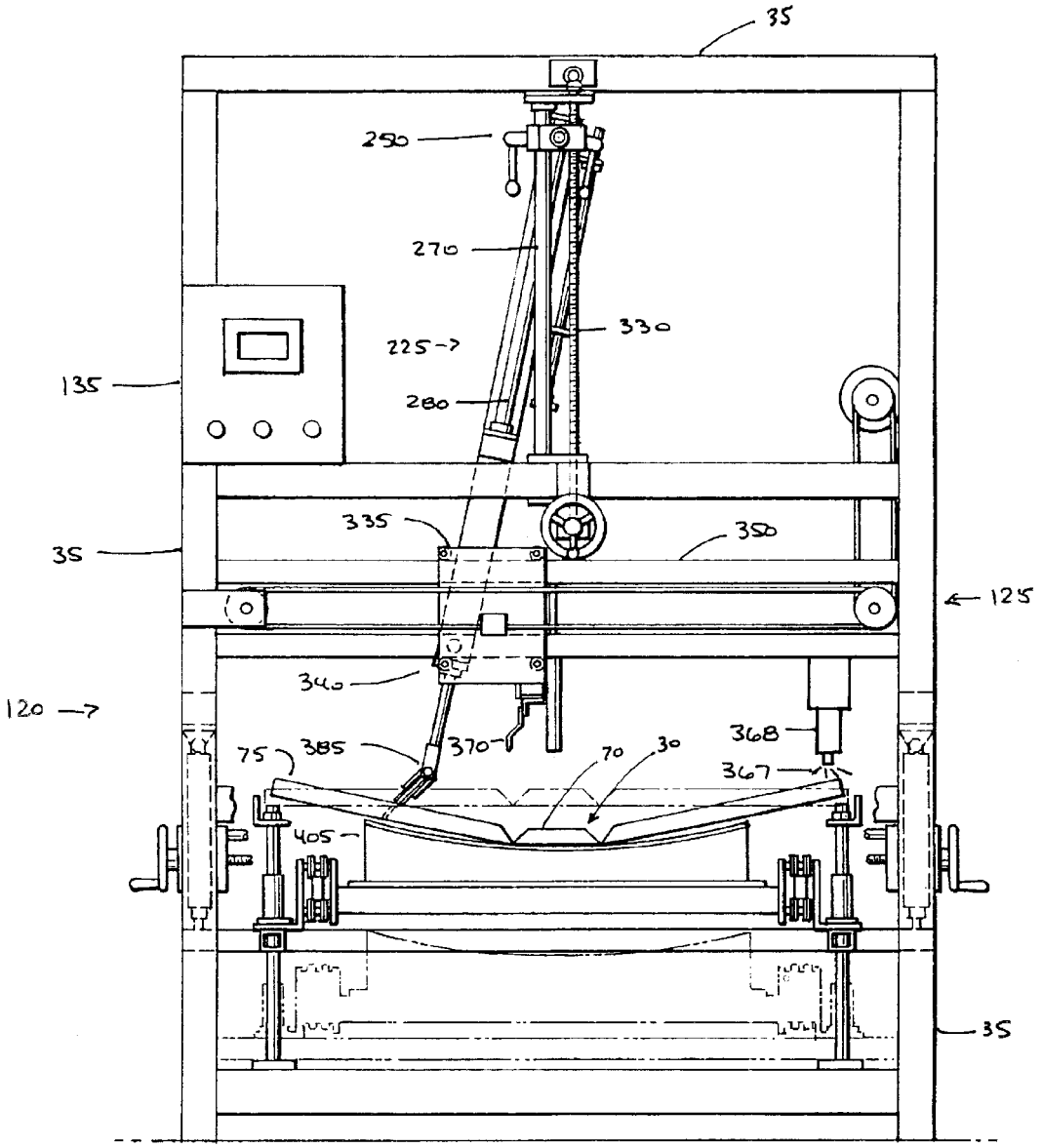
FIG. 32 is another perspective view of a construction embodying the present invention.

In a preferred embodiment depicted in FIG. 31, at least one gravity fed drip tube 366 is located adjacent the screen 160 for locating pigment containing material 367, or printing ink, onto the screen 160. In an alternative embodiment depicted in FIG. 32, at least one ink sprayer 368 is located adjacent the screen 160 for locating printing ink onto the screen 160. Pigment containing material may also be manually located on the screen 160.

A flood bar 370 is moveably connected to the lower portion 245 of the pendulum 225 as illustrated in FIG. 15. The flood bar 370 is constructed out of an aluminum alloy, however, other materials known in the art for constructing flood bars 370 are within the scope of the present invention.

The flood bar 370 is attached to means 375 located on the pendulum 225 for raising and lowering the flood bar 370 to the screen 160. In a preferred embodiment, the means 375 for raising and lowering the flood bar 370 includes at least one fluid driven cylinder 380. The fluid driven cylinder 380 may be either hydraulically or pneumatically driven. In either case, it is preferred that a computer 135 is in communication with the cylinder 380 to control the raising and the lowering of the flood bar 370 during the printing process. Other means for raising and lowering the flood bar 370 may include electric motors (not shown) or manually driven mechanical means (not shown).

As best seen in FIGS. 1 and 15, a squeegee 385 is also moveably connected to the lower portion 245 of the pendulum 225. The squeegee 385 is constructed out of a polyurethane material, however, other materials known in the art are well within the scope of the present invention. In a preferred embodiment, the squeegee 385 is adapted to selectively contact the screen 160 during pivotal movement of the pendulum 225. In a more preferred embodiment, the squeegee 385 is attached to means 390 located on the pendulum 225 for raising and lowering the squeegee 385 to the screen 160. In a most preferred embodiment, the means 390 for raising and lowering the squeegee 385 is at least one fluid driven cylinder 395 substantially as disclosed above for the flood bar 370. The squeegee 385 is pivotally attached 400 in at least one place to the pendulum 225 to allow the angle at which the squeegee 385 contacts the screen 160 to be adjusted.

Figure 20:
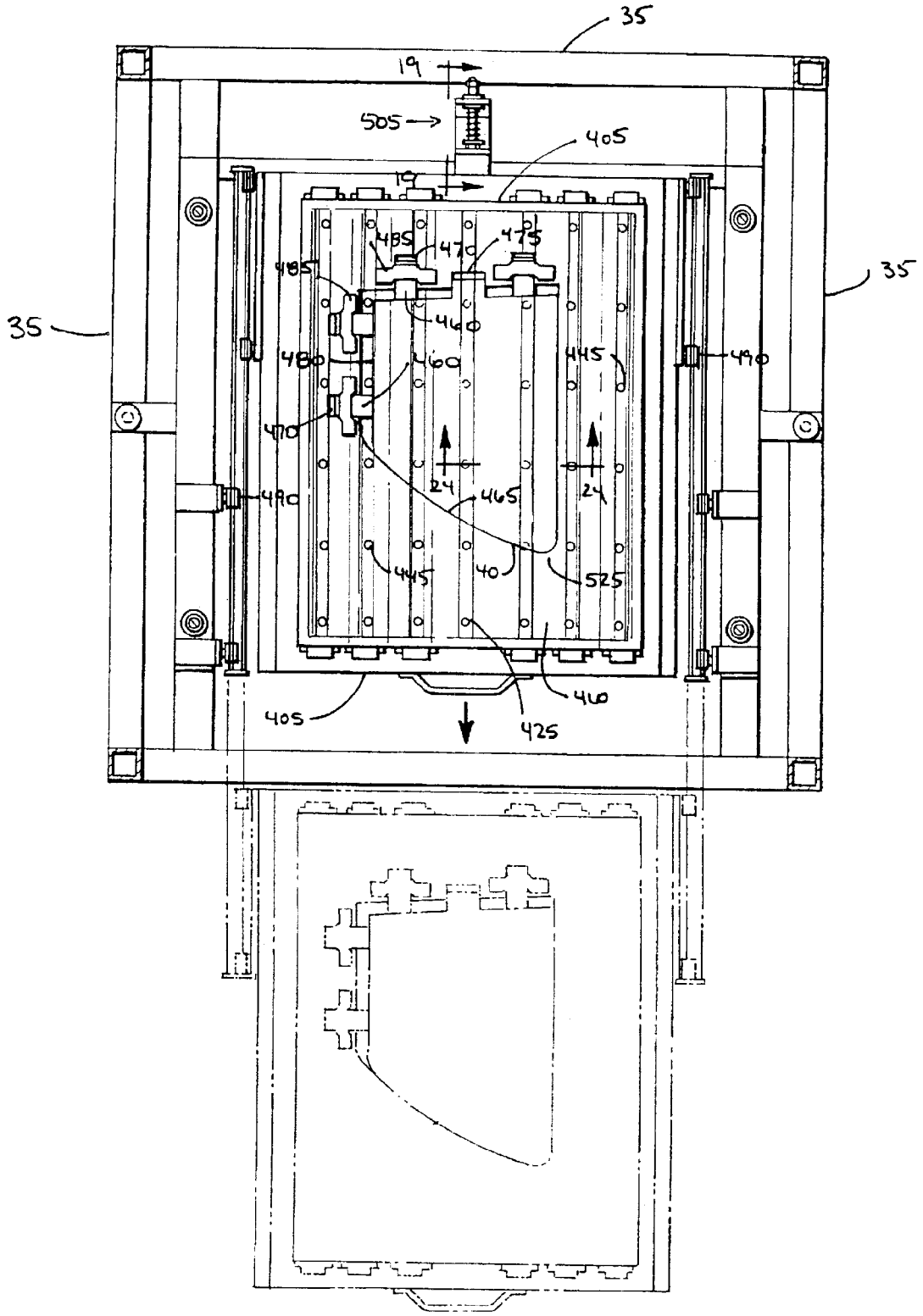
FIG. 20 is a top view of a substrate located on a support member embodying the construction of the present invention.

As depicted in FIG. 20, the curved substrate 40 is supported by a support member 405 having an upper surface 410. Preferably, the upper surface 410 is constructed of a polycarbonate material. In a preferred embodiment, a recess 415 is formed in the polycarbonate material which substantially conforms to the shape and curvature of the substrate 40 as illustrated in FIGS. 23 and 24.

Figure 21:
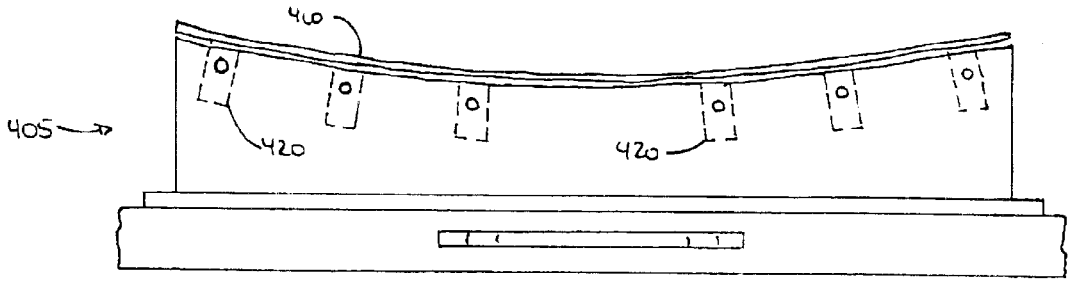
FIG. 21 is a side view of the support member embodying the construction of the present invention.

In one embodiment depicted in FIG. 21, the support member 405 has a plurality of fixed support bars 420 located beneath the upper surface 410. In this embodiment, the fixed support bars 420 can accommodate an upper surface 410 which substantially conforms to the location of the support bars 420. If the desired upper surface 410 does not substantially conform to the fixed support bars 420, a different support member 405 must be used.

Figure 23:
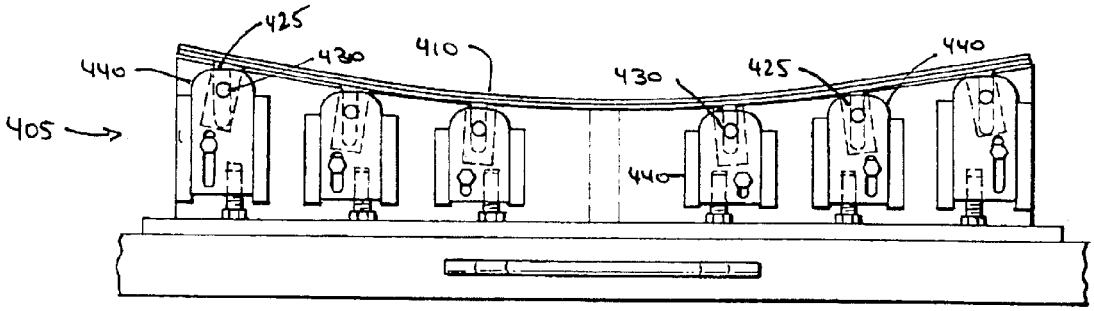
FIG. 23 is a side view of the support member embodying the construction of the present invention.
Figure 24:
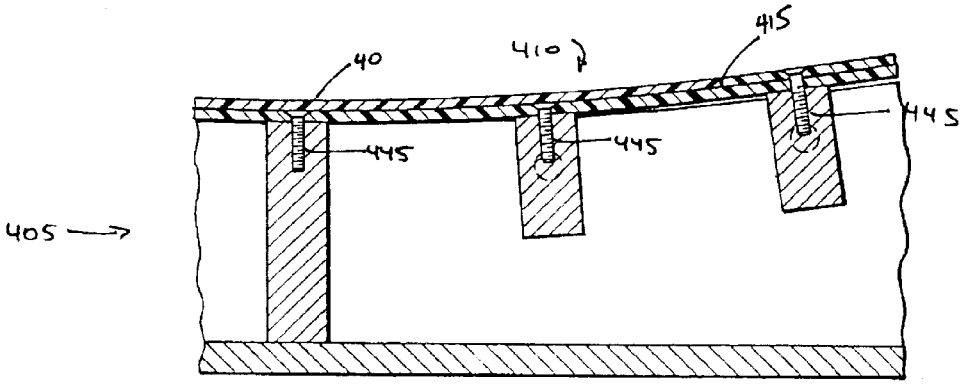
FIG. 24 is a sectional view, taken in the direction of the arrows, along section line 24—24 of FIG. 20.

In an alternative preferred embodiment, the support member 405 has a plurality of adjustable support bars 425 located beneath the upper surface 410 as illustrated in FIGS. 20 and 23. The adjustable support bars 425 are pivotally mounted 430 and vertically adjustable 435 to conform to a plurality of upper surfaces 410 for a plurality of substrates 40 having different curvatures. The support bars 425 are vertically adjustable with slides 440 located on the support member 405. The adjustable support bars 425 allow a single support member 405 to remain connected, as described below, to the support structure 35.

The upper surface 410 is mechanically connected to the support member 405, preferably with a plurality of screws 445, however, other mechanical fasteners known in the art are well within the scope of the invention.

The substrate 40 is located on the upper surface 410 according to two preferred embodiments. In a first embodiment depicted in FIG. 22, a vacuum 450 securely locates the substrate 40 in the recess 415 of the upper surface 410 of the support member 405. The upper surface 410 of the support member 405 has a plurality of apertures 455 in communication with the vacuum 450. The apertures 455 communicate the vacuum 450 to the substrate 40 and urge it downwardly in the recess 415 during the printing process. The vacuum 450 secures the substrate 40 within the recess 415 so that the substrate 40 is located flush with the upper surface 410.

Figure 25:
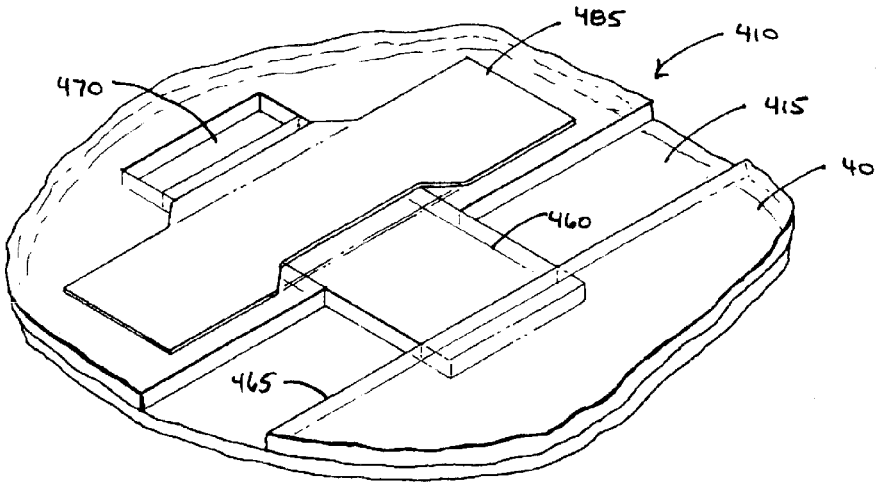
FIG. 25 is a fragmentary sectional view showing a portion of the construction shown in FIG. 20.
Figure 26:
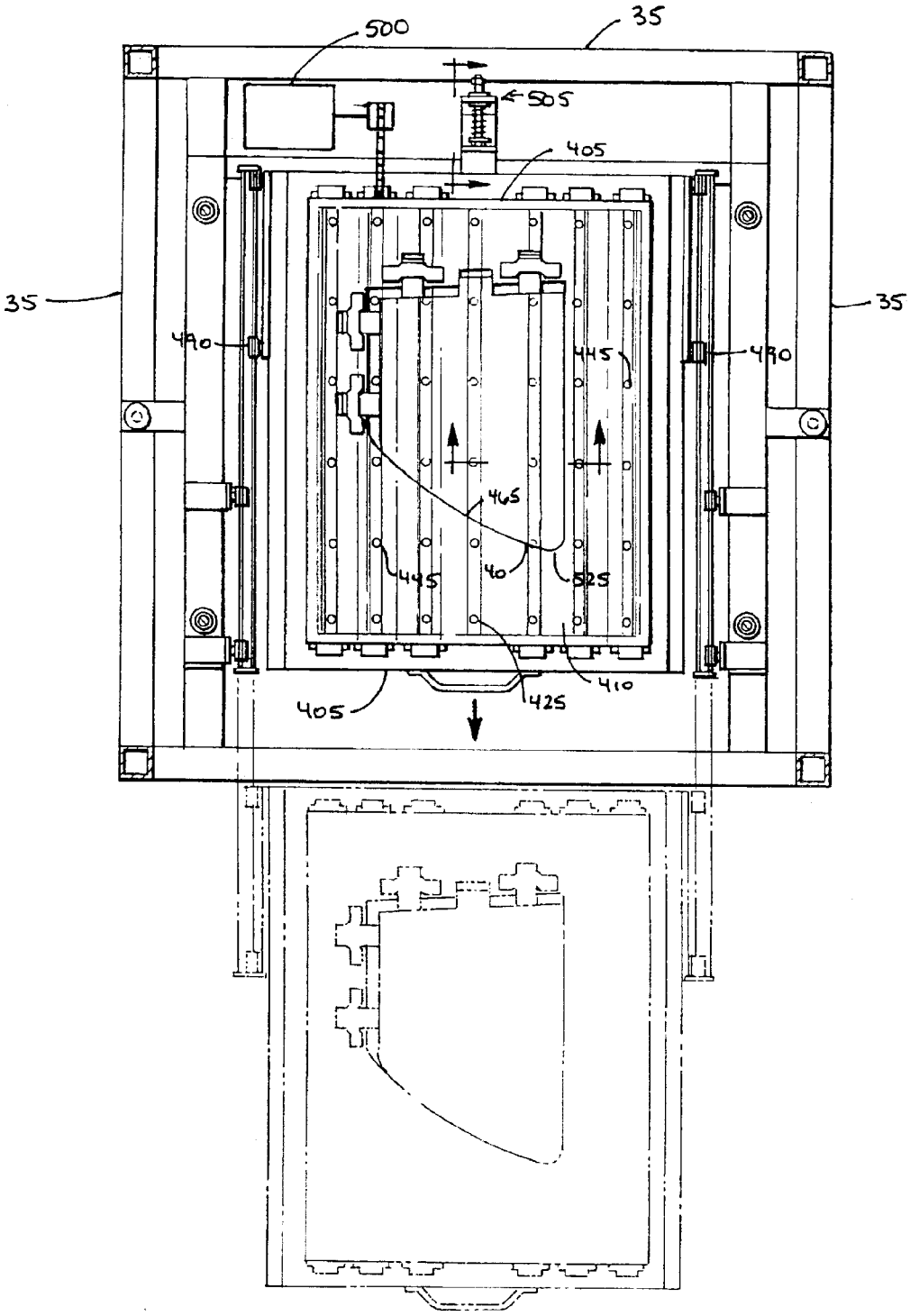
FIG. 26 is a top view of a substrate located on a support member embodying another construction of the invention.

In a second embodiment depicted in FIG. 20, at least one male fitting 460 located on a perimeter edge 465 of the substrate 40 is located within a corresponding female fitting 470 located on the upper surface 410 of the support member 405. Where there is more than one male fitting 460, they are preferably located on adjacent perimeter edges 465. In a more preferred embodiment, the male fittings 460 are located on a right side 475 and a trailing edge 480 of the substrate 40. A section of tape 485 is located across each male fitting 460 to securely locate the substrate 40 in the recess 415 and to ensure that the substrate 40 is located flush with the upper surface 410, as depicted in FIGS. 20 and 25.

In an alternative embodiment, the upper surface 410 has at least two crosshairs 486 located thereon. The crosshairs 486 are aligned with the crosshairs 191 located on the screen 160 as will be described in more detail below.

As shown in FIG. 20, the support member 405 has a plurality of wheels 490 which engage at least one substantially horizontal track 495. The track 495 is oriented to locate the support member 405 substantially beneath the screen 160 during the printing process. The track 495 allows the support member 405 to be slidably removed from the support structure 405 to load or unload a substrate 40 therefrom.

Figure 27:
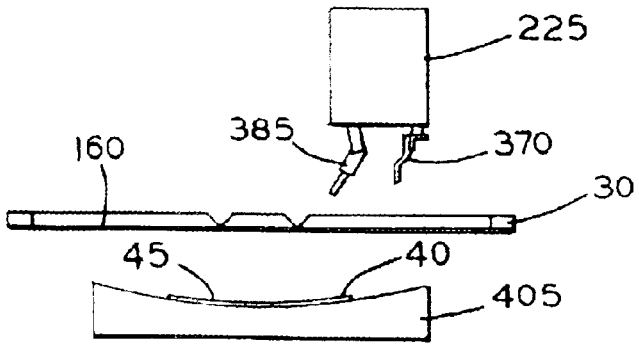
FIG. 27 is a diagrammatic view of a construction embodying the present invention.

A motor 500, depicted in FIG. 27, for moving the support member 405 along the track 495 is preferably connected to the support member 405. In a preferred embodiment, the motor 500 is in communication with a computer 135 to energize and de-energize the motor 500 during the printing process. In an alternative embodiment, the support member 405 may be manually moved along the track 495.

Figure 19:
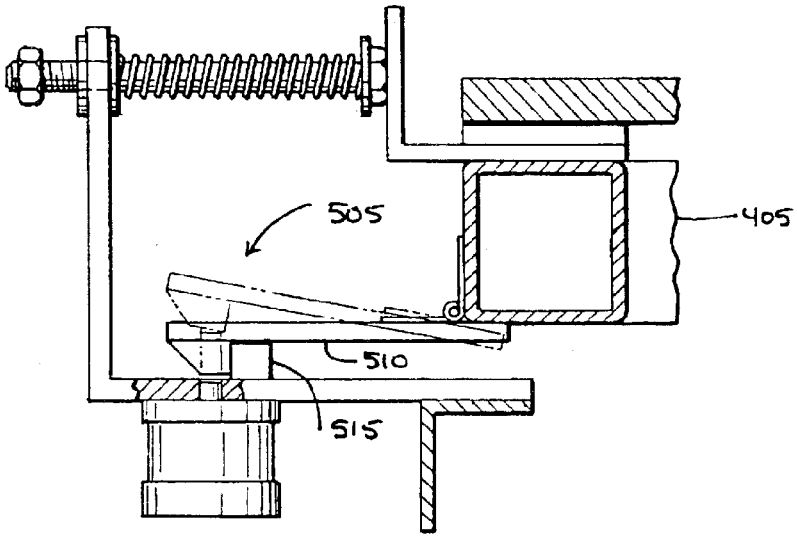
FIG. 19 is a section view, taken in the direction of the arrows, along section 19—19 of FIG. 20.

A locking device 505, as depicted in FIG. 19, engages the support member 405 to reduce, or prevent, lateral movement of the support member 405 during the printing process. Preferably, the locking device 505 has a spring-loaded male portion 510 which is received by a catch 515. The male portion 510 may be released from the catch 515 either manually or by engaging a solenoid (not shown) which urges the male portion 510 free from the catch 515. Preferably, the solenoid is in communication with the computer 135 for control.

The process of printing on the inside radius 45 of a substrate 40 is described hereinafter. As shown in FIG. 3, the screen 160 having a pattern 520 to be imparted to the substrate 40 is connected to the screen mounting frame 30 preferably with an adhesive. The screen 160 is connected to the screen mounting frame 30 so that tension is located in the screen 160 substantially between the right 50 and left 55 sides of the frame 30. Preferably, substantially no tension is provided in the screen 160 between the front portion 60 and the rear portion 65 of the mounting frame 30. Placing tension in the screen 160 only between the right side 50 to the left side 55 reduces, or prevents, wrinkling, or tenting, of the screen 160 when the screen 160 is deflected during the printing process.

The screen mounting frame 30, having a screen 160 mounted therein, is located on the flanges 195 of the support structure 35. Preferably, the screen mounting frame 30 is manually located on the flanges 195.

In one embodiment depicted in FIG. 5, the screen mounting frame 30 is located within at least one clamp 85 to connect it with the means for vertical movement 145. Preferably, the center portion of the screen mounting frame 70 is located within the clamp 85.

In an alternative embodiment depicted in FIGS. 7 through 12, the center portion of the screen mounting frame 70 is located within the screen mounting frame locator with driving rods 90 and the screen mounting frame locator without driving rods 140.

As shown in FIG. 20, the support member 405 is moved out of the support structure 35 by first releasing the locking device 505 and then rolling the support member 405 from the support structure 35 along the tracks 495. The support member 405 moves out of the support structure 35 either manually or by the motor 500 discussed above. The support member 405 moves along the track 495 until the support member 405 is substantially free from the support structure 35.

In the embodiment wherein the support member 405 is adjustable, the pivotally mounted, vertically adjustable support bars 425 are located to substantially conform to the upper surface 410 of the support member 405. The upper surface 410 is selected to conform substantially to the shape and curvature of the substrate 40 and then connected to the support member 405.

The substrate 40 is loaded into the support member 405 either manually or robotically or by other suitable means. In the embodiment depicted in FIG. 22 wherein a vacuum 450 is used to secure the substrate 40 onto the support member 405, the vacuum 450 is engaged thereby urging the substrate 40 securely into the recess 415. In the alternative embodiment depicted in FIG. 20, the male fitting 460 located on the perimeter edge 465 of the substrate 40 engages the corresponding female fitting 470 located on the upper surface 410 of the support member 405. A section of tape 485 is located across each male fitting 460. The tape 485 urges the substrate 40 into a lower left hand corner 525 of the support member 405. Urging the substrate 40 into the lower right hand corner 525 of the support member 405 resists, or prevents, the substrate 40 from moving out of the recess 415 as the squeegee 385 moves over the substrate 40 through the screen 160.

The support member 405 is then moved back into the support structure 35 either manually or by the above-mentioned motor 500. The locking device 505 engages the support member 405 thereby reducing, or preventing, lateral motion of the support member 405 once the support member 405 is located within the support structure 35.

As shown in FIG. 2, the support member 405 is moved vertically until located adjacent a lower surface 530 of the screen 160. The vertical motion may be imparted to the support member 405 manually or at least one computer actuated fluid driven cylinder 535.

Figure 22:
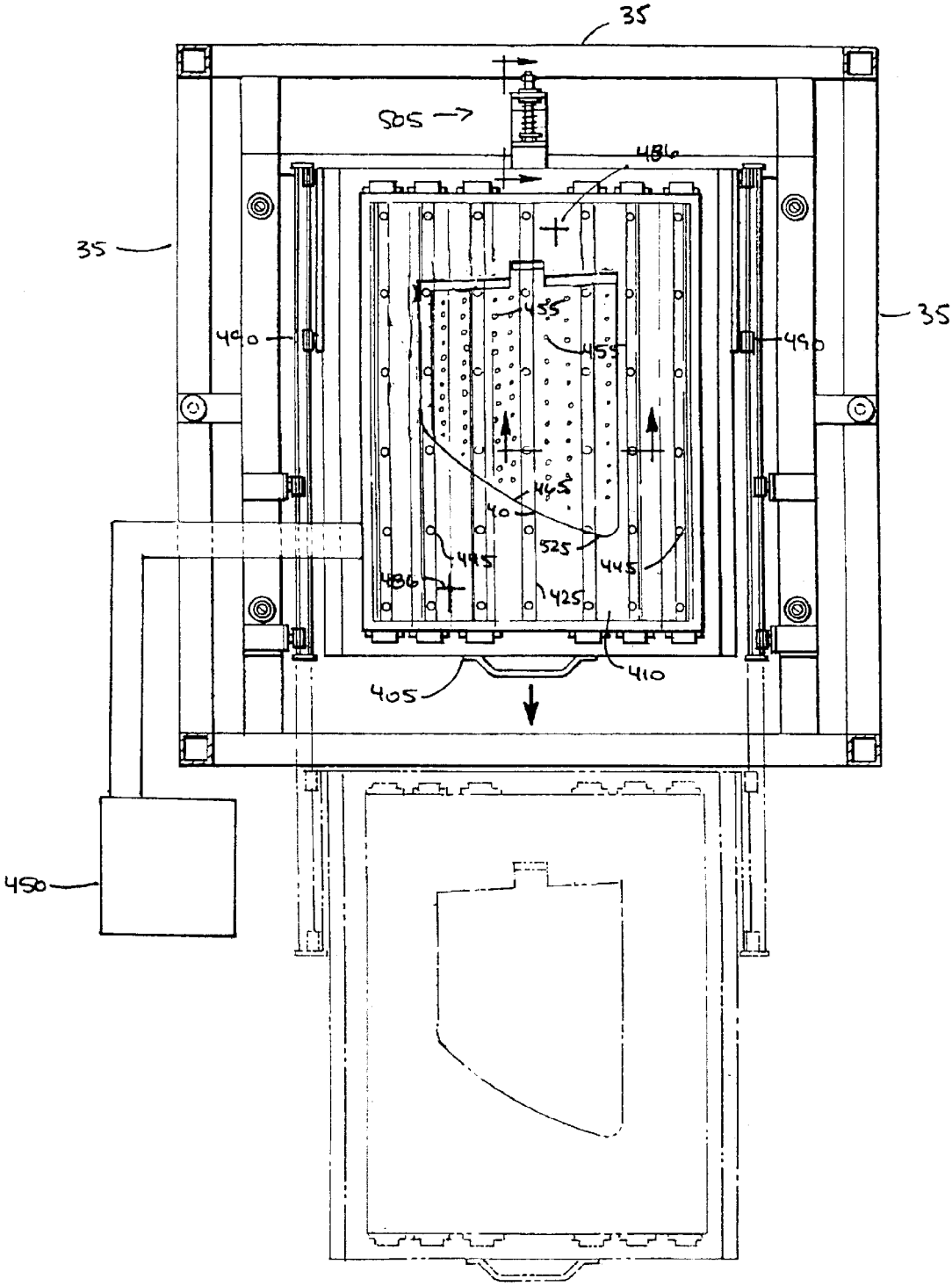
FIG. 22 is a top view of a substrate located on a support member embodying the construction of the present invention.

The screen 160 and the substrate 40 are aligned manually either by the operator matching the screen 160 with the substrate 40 or by the operator aligning the crosshairs 486 on the, substrate 160 and the crosshairs 191 on the screen 160 as shown in FIGS. 4 and 22. The crosshairs can also be aligned by the computer 135.

In the embodiment wherein the distance 220 between the center 175 of the screen 160 and the substrate 40 needs to be increased, spacers 215 are inserted into the apertures 205 located in the flanges 195 as depicted in FIGS. 7–8, 10–11 and 13. The spacers 215 are designed having varying degrees of thickness so if a small increase in distance 220 is required, one or more thin spacers 215 are located in the apertures 205. Conversely, if a large increase in distance 220 is required, one or more thick spacers 215 are located in the apertures 205.

In the embodiment wherein the distance 540 between the sides 180, 185 of the screen 160 and the substrate 40 needs to be increased, the pivotal clamps 150 are moved inward toward the center portion 70 as depicted in FIGS. 5 and 6. Moving the pivotal clamps 150 toward the center portion 70 causes a downward deflection of the center portion 70 to urge the end portions 75 upwardly at a greater angle from the screen 160 than if the pivotal clamps 150 were located away from the center portion 70. Locating the end portions 75 at a greater angle from the screen 160 increases the distance 540 from the side portions 180, 185 of the screen 160 to the substrate 40.

Pigment containing material 367, or printing ink, is located on an upper surface 545 of the screen 160, which is oriented in a substantially flat, horizontal orientation. FIG. 5 depicts the screen mounting frame is a substantially flat, horizontal orientation. Locating ink 367 on a horizontal screen 160 reduces, or prevents, the ink 367 from spreading to areas of the screen 160 where it is not desired.

Figure 28:
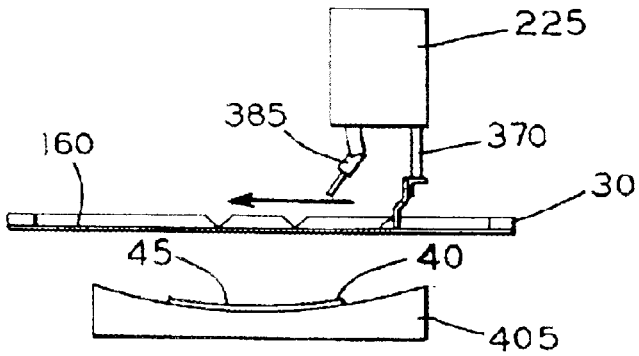
FIG. 28 is a diagrammatic view of the ink applied to a screen.
Figure 29:
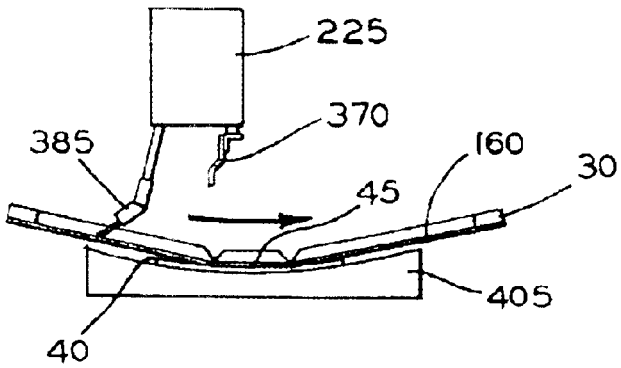
FIG. 29 is a diagrammatic view of a print stroke.

As depicted in FIG. 28, the pendulum 225 is located proximate the trailing portion 170 of the screen 160 to begin its printing stroke and so as not to obstruct the addition of ink to the screen 160. The ink 367 is evenly applied across the screen 160 by engaging the fluid driven cylinder 380 connected to the flood bar 370 which places the flood bar 370 in contact with the trailing portion 170 of the screen 160. The motor 365 connected to the carriage 340 is then activated by the computer 135, thereby moving the flood bar 370 across the upper surface 545 toward the leading portion 165 of the screen 160 as illustrated in FIG. 29. At the leading portion 165 of the screen 160, the fluid driven cylinder 380 is engaged and the flood bar 370 moves away from the leading portion 165 of the screen 160.

The computer 135 then actuates the fluid driven cylinder 145 connected to the center portions 70 of the screen mounting frame 30. The center portions 70 are driven downward thereby deflecting the end portions 75 and placing the screen 160 in a predetermined curvilinear shape substantially identical to the curvature of the substrate 40 as depicted in FIG. 6.

Figure 30:
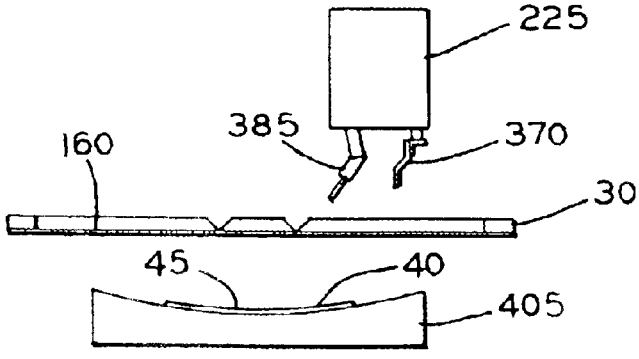
FIG. 30 is diagrammatic view of a construction embodying the present invention.

With the screen 160 in the deflected orientation, the computer 135 actuates the fluid driven cylinder 395 connected to the squeegee 385 to move the squeegee 385 toward the leading portion 165 of the screen 160 until contact is made. As depicted in FIG. 30, the motor 365 is connected to the carriage 340 is engaged by the computer 135 thereby moving the squeegee 385 in a pendular motion from the leading portion 165 to the trailing portion 170 of the screen 160. The pendular motion of the squeegee 385 against the screen 160 urges the screen 160 against the substrate 40 and the ink 367 through the screen 160 and onto the substrate 40.

The tension in the screen 160 urges the screen 160 away from the substrate 40 after the squeegee 385 has passed. Urging the screen 385 away from the substrate 40 reduces, or prevents, the possibility of smearing or distorting the ink 367 applied to the substrate 40.

The computer 135 again actuates the fluid driven cylinder 395 connected to the squeegee 385 thereby moving the squeegee 385 away from the trailing portion 170 of the screen 160 as illustrated in FIG. 31. The fluid driven cylinders 145 connected to the center portions 70 of the screen mounting frame 30 are actuated thereby moving the screen 160 to a substantially flat, horizontal position. In a process which is substantially the reverse of the load process described above, the support member 405 moves downwardly from the screen 160 and then outwardly from the support structure 35. The substrate 40, now having printing located thereon, is removed from the support member 405 either manually or robotically.

In the embodiment wherein the radius 255 of the pendulum 225 is adjustable and adjustment is required, the pendulum 225 is attached to the support structure 35 by threadably engaging at least two connecting rods 550 attached to the pendulum 225 with the support structure 35. Attaching the pendulum 225 to the support structure 35 removes the weight of the pendulum 225 from the pivotal mountings 305, 310. With the weight of the pendulum 225 removed from the pivotal mountings 305, 310, the mountings 305, 310 may be released from the support structure pivotal mounting bar 270 and the pendulum pivotal mounting bar 280. The pivotal mountings 305, 310 may then be adjusted up or down to increase or decrease the radius 255 of the pendulum 225, respectively. The pivotal mountings 305, 310 are adjusted by rotating at least one wheel 555 mechanically connected to the threaded rod 315. Rotation of the rod 315 causes the pivotal mountings 305, 310 to adjust up or down. Additionally, as the rod 315 is mechanically connected to the left pivotal mounting 310, rotation of the wheel 555 causes the left pivotal mounting 310 to be adjusted to an identical location as the first pivotal mounting 305.

The pivotal mountings 305, 310 are then re-attached to the pendulum pivotal mounting bar 280 and the support structure pivotal mounting bar 270. The pendulum 225 is then released from the support structure 35 by disengaging the connecting rods 550 from the support structure 35.

In accordance with the provisions of the patent statutes, the present invention has been described in what is considered to represent its preferred embodiments, however, it should be noted that the invention can be practiced otherwise than as specifically illustrated and described without departing from its scope or spirit.

What is claimed is:

1. An apparatus for printing on the inside radius of a curved substrate, comprising:

a curved substrate having an inside radius for locating printing thereon;

a screen mounting frame, conformable to said substrate;

a screen secured to said screen mounting frame;

a pendulum mounted for pivotal movement above said screen; and a squeegee connected to the end of said pendulum and adapted to selectively contact said screen during pivotal movement of said pendulum.

2. An apparatus as defined in claim 1, wherein said curved substrate has an inside radius of approximately 20 to 80 inches.

3. An apparatus as defined in claim 1, wherein said curved substrate has an inside radius of approximately 38 to 60 inches.

4. An apparatus as defined in claim 1, wherein said curved substrate, said screen mounting frame, and said pendulum are mounted within a support structure.

5. An apparatus as defined in claim 4, wherein said support structure has at least one flange for locating thereon said screen mounting frame.

6. An apparatus as defined in claim 5, wherein a horizontal portion of said at least one flange has a plurality of apertures.

7. An apparatus as defined in claim 6, wherein said at least one flange accommodates at least one spacer within said plurality of apertures for locating thereon said screen mounting frame for increasing the distance between said curved substrate and said center portion of said screen.

8. An apparatus as defined in claim 1, wherein said screen mounting frame has a front, a rear, a left side and a right side.

9. An apparatus as defined in claim 8, wherein both said left and right sides of said screen mounting frame have a vertically movable center portion and at least two vertically movable end portions.

10. An apparatus as defined in claim 9, wherein said center portion is bounded by at least two hinges.

11. An apparatus as defined in claim 10, wherein said center portion is removably attached to means for vertical movement.

12. An apparatus as defined in claim 11, wherein said center portion is removably attached to said vertically moving means by at a screen mounting frame locator.

13. An apparatus as defined in claim 12, wherein said screen mounting frame locator has means for adjusting the location of said screen mounting frame with respect to said substrate.

14. An apparatus as defined in claim 13, wherein said means for adjusting the location of said screen mounting frame with respect to said substrate are manual.

15. An apparatus as defined in claim 13, wherein said means for adjusting the location of said screen mounting frame with respect to said substrate are computer activated.

16. An apparatus as defined in claim 11, wherein said center portion is removably attached to said vertically moving means by at least one clamp.

17. An apparatus as defined in claim 11, wherein said means for vertical movement is at least one fluid driven cylinder.

18. An apparatus as defined in claim 9, wherein said end portions are removably attached to said support structure with pivotal clamps.

19. An apparatus as defined in claim 1, wherein said screen is a high tension, low elongation material capable of receiving and transferring printing ink.

20. An apparatus as defined in claim 1, wherein said screen is a monofilament polyester material.

21. An apparatus as defined in claim 1, wherein said screen mounting frame holds said screen in tension from said right side to said left side.

22. An apparatus as defined in claim 1, wherein said screen mounting frame holds said screen with substantially no tension from said front to said rear of said screen.

23. An apparatus as defined in claim 1, wherein said screen has a perimeter, a center portion, a leading portion, a trailing portion, a right portion, and a left portion.

24. An apparatus as defined in claim 23, wherein said screen perimeter is secured to said screen mounting frame by adhesive.

25. An apparatus for printing on the inside radius of a curved substrate comprising:

a curved substrate having an inside radius for locating printing thereon;

a screen mounting frame, conformable to said substrate;

a screen secured to said screen mounting frame;

a pendulum adjustably mounted above said screen, allowing said pendulum to travel through a plurality of radii;

a squeegee connected to the end of said pendulum and adapted to selectively contact said screen during pivotal movement of said pendulum.

26. An apparatus as defined in claim 25, wherein said pendulum has at least one pivotal mounting to said support structure.

27. An apparatus as defined in claim 26, wherein said pivotal mounting is connected to a pivotal mounting bar located on said pendulum and to a pivotal mounting bar located on said support structure.

28. An apparatus as defined in claim 27, wherein said pivotal mounting is releasably attached to said pendulum pivotal mounting bar and said support structure pivotal mounting bar to create a pivot point about said pivotal mounting for said pendulum.

29. An apparatus as defined in claim 28, wherein pendulum has at least one locking rod for locking said pendulum to said support structure while said at least one pivotal mounting is adjusted.

30. An apparatus as defined in claim 25, wherein said radii are approximately 20 to 80 inches measured from said pivotal mounting to said curved substrate.

31. An apparatus as defined in claim 30, wherein said radii are approximately 38 to 60 inches measured from said pivotal mounting to said curved substrate.

32. An apparatus as defined in claim 25, further comprising indicating means for indicating the radius of said pendulum.

33. An apparatus as defined in claim 32, wherein said indicating means includes an indicator connected to said pivotal mounting and an index connected to said support structure.

34. An apparatus as defined in claim 25, wherein said pendulum is connected to translation means for translating said pendulum across said screen.

35. An apparatus as defined in claim 34, wherein said translation means includes at least one carriage moveably located on said support structure and connected to said pendulum.

36. An apparatus as defined in claim 35, wherein said at least one carriage is computer actuated.

37. An apparatus as defined in claim 36, wherein said pendulum translates over a cam within said carriage as said carriage translates along said frame.

38. An apparatus as defined in claim 37, wherein said cam adjusts for the varying vertical position of said pendulum as said pendulum translates across said screen.

39. An apparatus as defined in claim 38, wherein said carriage translates across said frame according to belt driven means.

40. An apparatus as defined in claim 25, further comprising a flood bar connected to said pendulum.

41. An apparatus as defined in claim 40, wherein said flood bar is an aluminum alloy.

42. An apparatus as defined in claim 40, wherein said flood bar is connected to means located on said pendulum for raising and lowering said flood bar to said screen.

43. An apparatus as defined in claim 42, wherein said means for raising and lowering said flood bar is at least one fluid driven cylinder.

44. An apparatus as defined in claim 43, wherein said cylinder is computer actuated.

45. An apparatus as defined in claim 25, wherein said squeegee is attached to means located on said pendulum for raising and lowering said squeegee to said screen.

46. An apparatus as defined in claim 45, wherein said means for raising and lowering said squeegee is at least one fluid driven cylinder.

47. An apparatus as defined in claim 46, wherein said cylinder is computer actuated.

48. An apparatus as defined in claim 25, wherein said squeegee is a polyurethane material.

49. An apparatus as defined in claim 25, wherein said squeegee is pivotally attached to said pendulum.

50. An apparatus for printing on the inside radius of a curved substrate, comprising:

a curved substrate having an inside radius for locating printing thereon;

a screen mounting frame, conformable to said substrate;

a screen secured to said screen mounting frame;

a pendulum mounted for pivotal movement above said screen; and a squeegee connected to the end of said pendulum and adapted to selectively contact said screen during pivotal movement of said pendulum; and a support member adapted to support said curved substrate, said support member having an upper surface with a curvature which substantially conforms to the curvature of said curved substrate.

51. An apparatus as defined in claim 50, wherein said screen has at least two crosshairs located thereon for alignment with at least two crosshairs located on said support member.

52. An apparatus as defined in claim 50, wherein said upper surface is a polycarbonate material.

53. An apparatus as defined in claim 52, wherein said upper surface has a recess substantially conforming to said shape and curvature of said curved substrate.

54. An apparatus as defined in claim 53, wherein a vacuum secures said curved substrate into said recess.

55. An apparatus as defined in claim 54, wherein said upper surface has a plurality of apertures in said recess in communication with said vacuum source.

56. An apparatus as defined in claim 53, wherein a locking tab located on said substrate urges said curved substrate into said recess.

57. An apparatus as defined in claim 50, wherein said support member has a plurality of fixed support bars located beneath said upper surface.

58. An apparatus as defined in claim 50, wherein said support member has a plurality of adjustable support bars located beneath said upper surface.

59. An apparatus as defined in claim 58, wherein said adjustable support bars are pivotally mounted, vertically adjustable located proximate said upper surface.

60. An apparatus as defined in claim 50, wherein said support member is adapted for horizontal and vertical movement.

61. An apparatus as defined in claim 60, wherein said support member has a plurality of wheels engaged with at least one track located on said support structure to effect horizontal movement of said support member.

62. An apparatus as defined in claim 61, wherein said support member is connected to a motor to effect horizontal movement of said support member.

63. An apparatus as defined in claim 61, wherein said horizontal movement is effected manually.

64. An apparatus as defined in claim 60, wherein said support member has at least one fluid driven cylinder located on said support structure and connected to said support member to effect vertical movement of said support member.

65. An apparatus as defined in claim 64, wherein said at least one cylinder is computer actuated.

66. An apparatus as defined in claim 50, wherein said support member has at least one locking means for preventing lateral movement of said support member.

67. An apparatus as defined in claim 66, wherein said locking means is a spring-loaded catch located on said support member for engagement with a complimentary receiver.

* * * * *